US007832609B2

(12) United States Patent
Matsukawa

(10) Patent No.: US 7,832,609 B2
(45) Date of Patent: Nov. 16, 2010

(54) STAPLER

(75) Inventor: Takeshi Matsukawa, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 143 days.

(21) Appl. No.: 12/211,468

(22) Filed: Sep. 16, 2008

(65) Prior Publication Data

US 2009/0072003 A1 Mar. 19, 2009

(30) Foreign Application Priority Data

Sep. 19, 2007 (JP) ..... 2007-242404

(51) Int. Cl.
*B25C 5/11* (2006.01)

(52) U.S. Cl. ..... 227/120; 227/127

(58) Field of Classification Search ..... 227/77, 227/120, 127, 128, 135, 154, 155, 156
See application file for complete search history.

(56) References Cited

U.S. PATENT DOCUMENTS 1,962,874 A * 6/1934 Polzer ..... 227/123
3,739,973 A * 6/1973 Abrams ..... 227/120
4,619,392 A * 10/1986 Won ..... 227/120
5,421,502 A * 6/1995 Huang ..... 227/134
5,516,025 A * 5/1996 Eriksson ..... 227/155
5,758,813 A * 6/1998 Kikuchi et al. ..... 227/155
5,765,742 A * 6/1998 Marks ..... 227/132
5,791,543 A * 8/1998 Udagawa et al. ..... 227/4
5,816,470 A * 10/1998 Plato et al. ..... 227/132
6,981,627 B2 * 1/2006 Tsai ..... 227/155
7,140,526 B2 * 11/2006 Matsukawa ..... 227/132
7,216,791 B1 * 5/2007 Marks ..... 227/132
7,431,186 B2 * 10/2008 Hsu ..... 227/120
7,621,432 B2 * 11/2009 Chiang et al. ..... 227/120
7,665,643 B2 * 2/2010 Huang ..... 227/128
2007/0023474 A1 * 2/2007 Smith et al. ..... 227/155
2007/0199971 A1 * 8/2007 Chen ..... 227/120
2007/0221699 A1 * 9/2007 Hsu ..... 227/134
2008/0029568 A1 * 2/2008 Hsu ..... 227/120
2009/0159637 A1 * 6/2009 Maemori ..... 227/120
2009/0289095 A1 * 11/2009 Huang ..... 227/120
2010/0012701 A1 * 1/2010 Huang et al. ..... 227/132

* cited by examiner

*Primary Examiner*—Paul R Durand
(74) *Attorney, Agent, or Firm*—The Marbury Law Group PLLC

(57) ABSTRACT

A stapler has a base portion including a rotatable clinching portion, a magazine portion pivotally attached to rotate to a position on the base portion, a push-down portion pivotally attached to rotate to a position on the base portion to be disposed above the magazine portion which has a driving blade in the vicinity of a front end thereof, and a handle member pivotally attached to rotate to a handle support member fixed to the base portion in a position on the handle member which is adapted to be brought into contact with the vicinity of a front end of an upper portion of the push-down member to lower the push-down member. The clinching portion includes a slider which slides along support shafts to permit a lowering operation of the clinching portion. The handle member includes a roller in contact with the push-down portion.

8 Claims, 17 Drawing Sheets

STAPLER

BACKGROUND OF THE INVENTION

1. Technical Field

Figure 1:
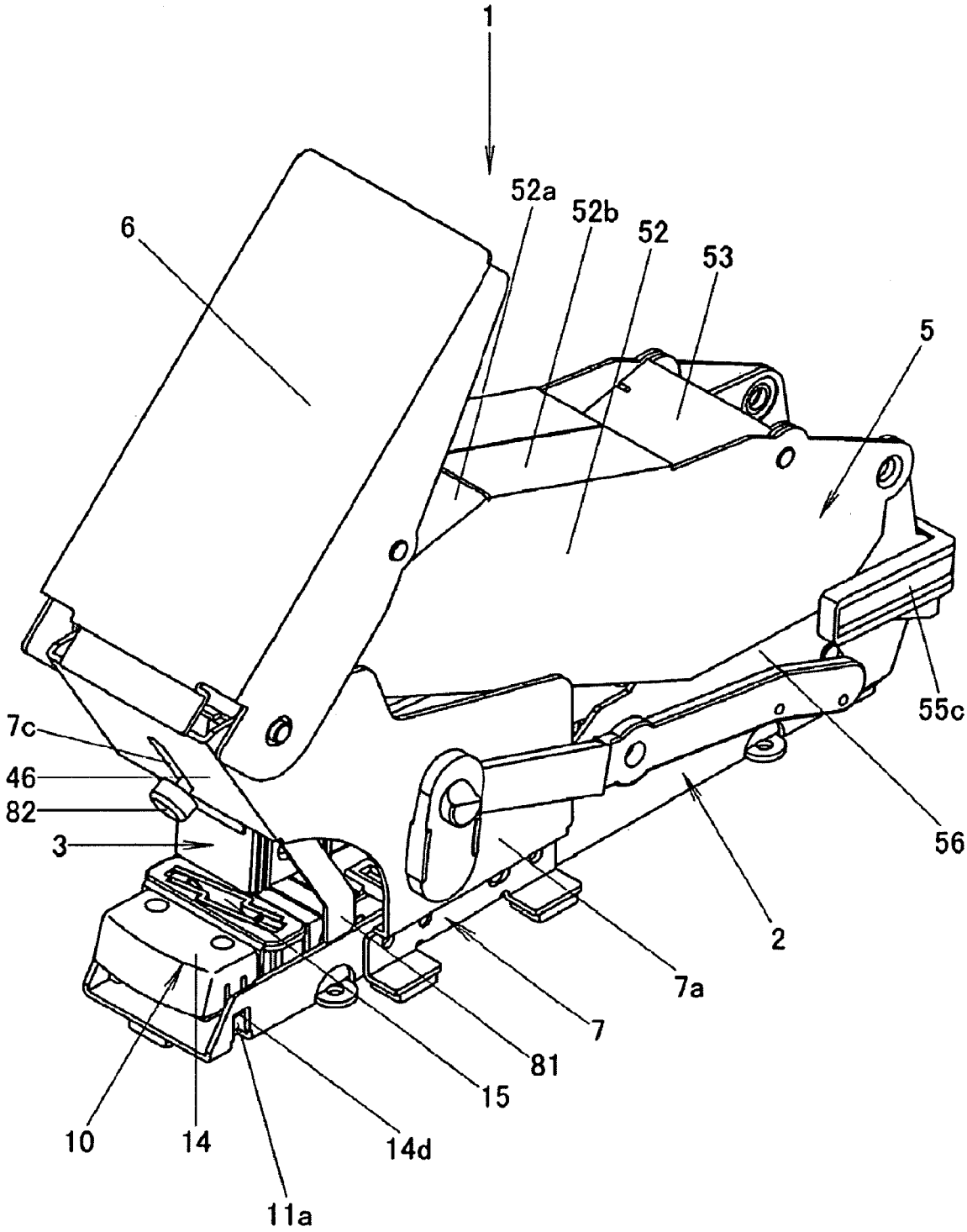

The present invention relates to a flat type stapler in which pointed end portions of a staple are bent flat after it has penetrated, for example, sheets of paper to be fastened together.

2. Background Art

A stapler is stationery for fastening together sheets of paper and is one of inevitable office materials. There have been proposed many staplers. In staplers, there are two types of staplers: one is a type in which pointed end portions of a stapler are bent in a curved fashion after it has penetrated sheets of paper to be fastened together, and the other type is a flat type in which pointed end portions of a stapler are bent flat after it has penetrated sheets of paper to be fastened together.

A general flat type stapler includes a base portion having a clincher, a magazine for accommodating strips of staples, a handle that is pivotally attached to rotate to a position on the base portion which lies in the vicinity of one end thereof, a driving blade which is disposed at a distal end portion of the handle for driving a staple in the magazine towards the clincher in association with the rotation of the handle, a table which has a clincher surrounding portion and performs a clinching operation by raising and lowering the clincher surrounding portion relative to the clincher, a slider made slidable in such a manner as to permit a lowering operation of the clincher surrounding portion at a predetermined timing in relation to the clinching operation by the table and a slider pushing member which is fixed to the handle in such a manner as to cause the slider to slide when the handle rotates.

The stapler configured as described above is such that when a distance between the handle and the base portion is reduced by gripping the handle and the base portion altogether, since the slider push member causes the slider to slide, a locked state of the table and the slider is released, whereby the table lowers, and a staple is pressed between the driving blade and the clincher in such a manner that pointed ends thereof are bent so as to fasten together sheets of paper.

In addition, Japanese Examined Utility Model Publication No. 63-43027 and Japanese Examined Utility Model Publication No. 2-48229 propose staplers in which a clincher is made up of two rotatable members. In these staplers, when a distance between a handle and a base portion is narrowed, the clincher rotates in such a manner that an upper portion of the clincher is made into a flat plane so as to bend flat pointed ends of a staple.

In staplers, there are two types of staplers: one is a hand-held stapler and the other is a desktop stapler. A desktop stapler has substantially the same basic construction as that of a hand-held stapler but is larger in size than the hand-held stapler. In addition, since the weight of the user is exerted on to a handle member to lower the handle member in such a state that the stapler is placed on a desk or the like at its base portion, a large number of sheets of paper can be fastened together at one time.

In the desktop stapler that has been described above, although a large magnitude of force becomes necessary to fasten together a large number of sheets of paper, since the handle is pivotally attached to rotate to a position on the base portion which lies in the vicinity of a rear end thereof, when such a large magnitude of force is applied to the vicinity of a distal end of the handle, there has been caused a problem that the rear end of the stapler is raised. In addition, in order to solve this problem, there is a method in which the base portion is formed long at the front thereof, but this has triggered another problem that the base portion is enlarged.

SUMMARY OF THE INVENTION

The present invention has been made in view of the problems described as being inherent in the related art, and an object thereof is to provide a flat type stapler in which a large number of sheets of paper can be fastened together with a small magnitude of force and the balance of the stapler is stabilized in stapling a batch of papers.

According to the invention, there is provided a stapler having a base portion which comprises a rotatable clinching portion, a magazine portion which is pivotally attached to rotate to a position on the base portion which lies in the vicinity of a rear end thereof by a spindle, a push-down portion which is pivotally attached to rotate to a position on the base portion which lies in the vicinity of the rear end thereof in such a manner as to be disposed above the magazine portion and which has a driving blade in the vicinity of a front end thereof, and a handle member which is pivotally attached to rotate to a handle support member which is fixed to the base portion in a position on the handle member which lies in the vicinity of a front end thereof and which is adapted to be brought into contact with the vicinity of a front end of an upper portion of the push-down member so as to lower the push-down member, wherein the clinching portion comprises a slider which permits a lowering operation of the clinching portion, wherein a plurality of sliding support shafts are penetrated through the slider, the slider sliding vertically relative to the sliding support shafts, and wherein the handle member comprises a roller in a position which is in contact with the push-down portion and lowers the push-down portion based on the principle of leverage in which the portion which is pivotally attached to rotate to the handle support member acts as a fulcrum, a rear end portion acts as a point of effort and the contact point with the push-down member acts as a point of application.

In addition, the magazine portion is of a front-loading type which comprises a slidable magazine main body, a magazine accommodating portion for accommodating the magazine main body and a magazine main body locking mechanism. Additionally, the magazine main body locking mechanism has a rotatable rear end locking member for locking and releasing a rear end of the magazine main body and a rotation arm for controlling the rotation of the rear end locking member.

Furthermore, the handle support member comprises a paper holding mechanism which is made up of a paper stopper member and a control member. The paper stopper member is made up of two side plates which are disposed in such a manner as to oppositely face each other and a connecting plate for connecting together the side plates in the vicinity of upper ends thereof and is disposed inside the handle support member in such a manner that a front wall of the handle support member and the connecting plate of the paper stopper member oppositely face each other. The control member is connected with the connecting plate of the paper stopper member via a sliding hole formed in the front wall of the handle support member. The paper stopper member is caused to move vertically by causing the control member to slide along the sliding hole.

Additionally, the driving blade is formed integrally with a leaf spring which comprises a slider pushing portion for locking the slider. The slider comprises a sliding support portion which is locked by the slider pushing portion, and a surface of the sliding support portion which is locked by the slider pushing portion is formed into a curved surface which matches the thickness of a bundle of papers to be fastened together.

According to the stapler of the invention, since the roller is disposed between the handle member and the push-down portion so as to fasten together sheets of paper by making use of the principle of leverage, a thick bundle of papers can be fastened together with a small magnitude of force. In addition, since the push-down portion is rotatably attached to the position on the base portion which lies in the vicinity of the rear end thereof and the handle member is rotatably attached to the position on the handle support member which lies in the vicinity of the front end thereof, the center of gravity of force applied at the time of clinching is situated in the vicinity of the center of the base portion, and since the front of the base portion does not have to be formed large, the stapler can be provided which is small in size and which can fasten together a large number of sheets of paper.

In addition, since the magazine portion is made to be of the front loading type, the handle member or the like does not have to be rotated largely when accommodating staples therein, whereby the accommodation of staples can be implemented through simple accommodating work.

Furthermore, since the paper holding mechanism is attached to the handle support member, the position where sheets of paper are clinched to be fastened together can be held constant. In addition, in the stapler in which the front end face of the sliding support portion of the slider which is locked with the slider pushing portion is formed into the curved shape which matches the thickness of the bundle of papers to be fastened together, the clinching timing is not changed even though the number of sheets of paper to be fastened together is changed, whereby the stable fastening or stapling is enabled.

BRIEF DESCRIPTION THE DRAWINGS

Figure 2:
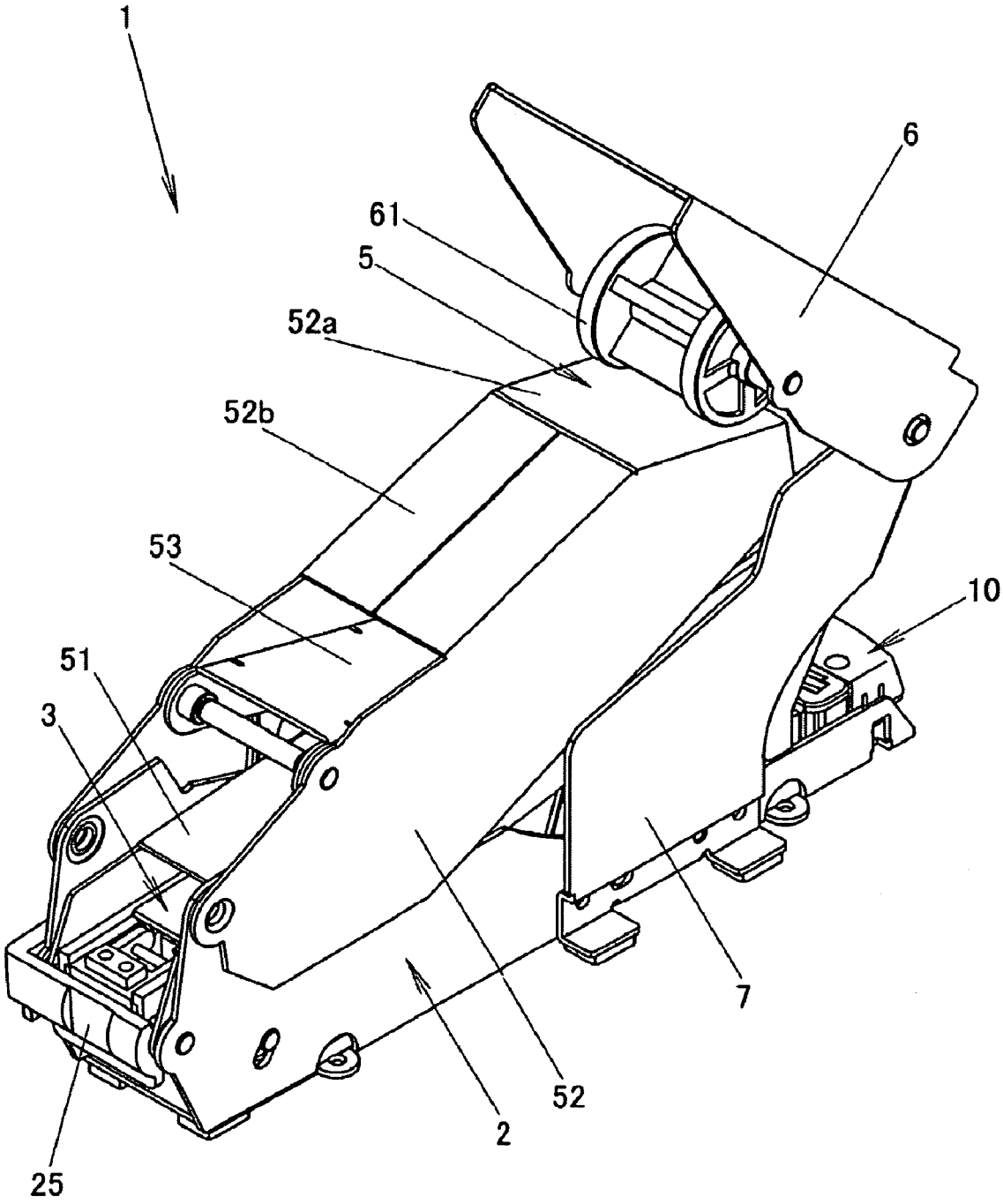
Figure 3:
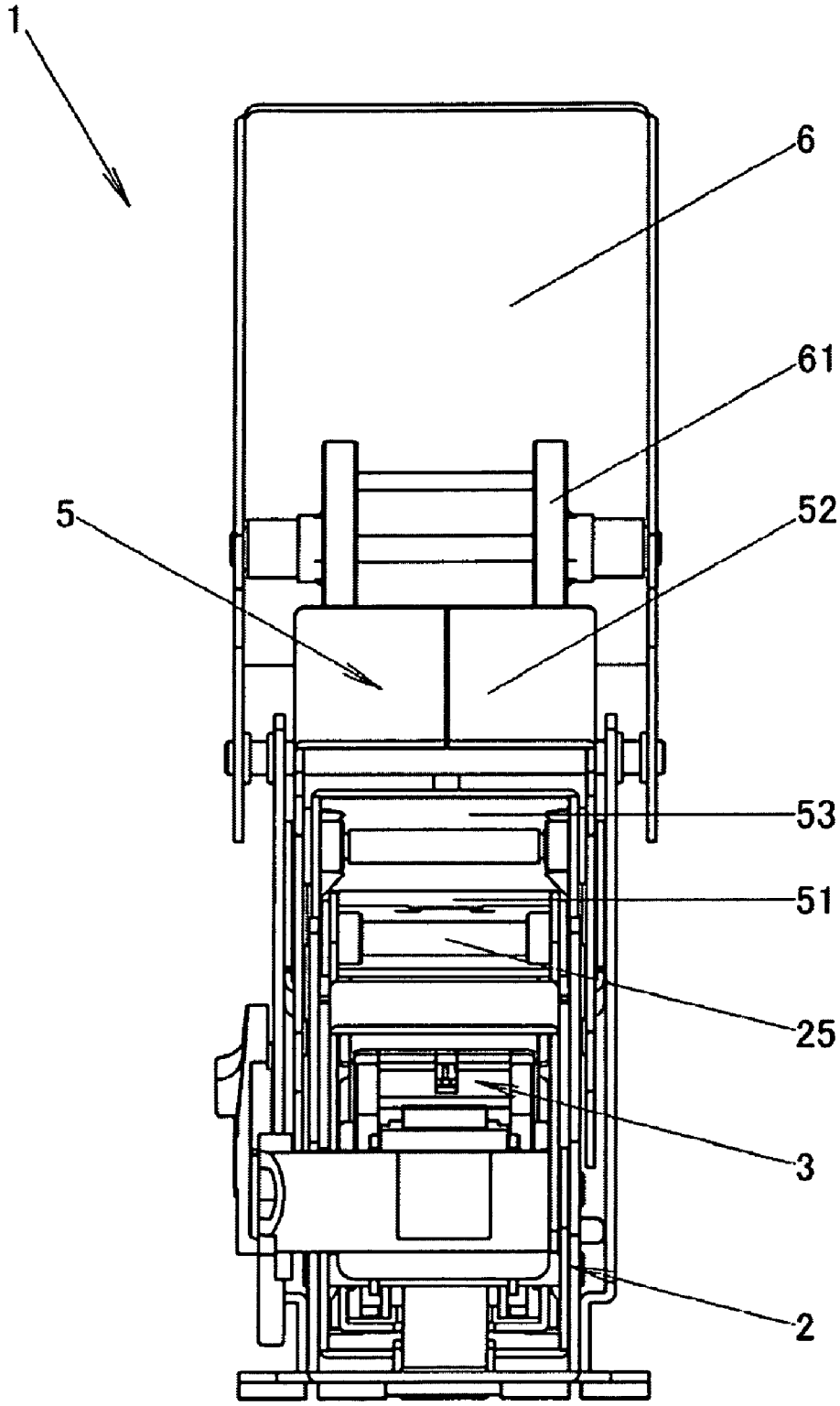
Figure 4:
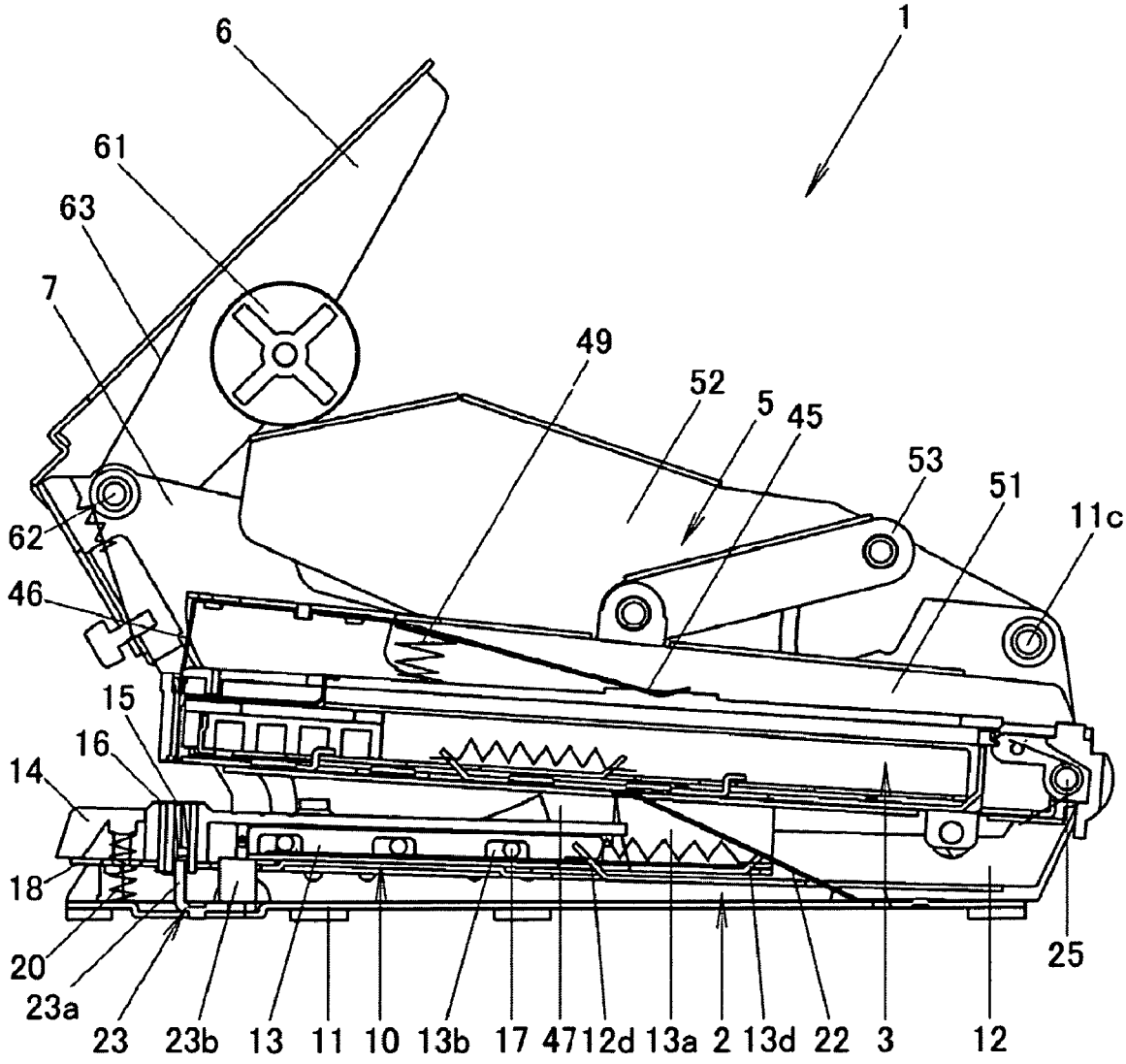
Figure 5:
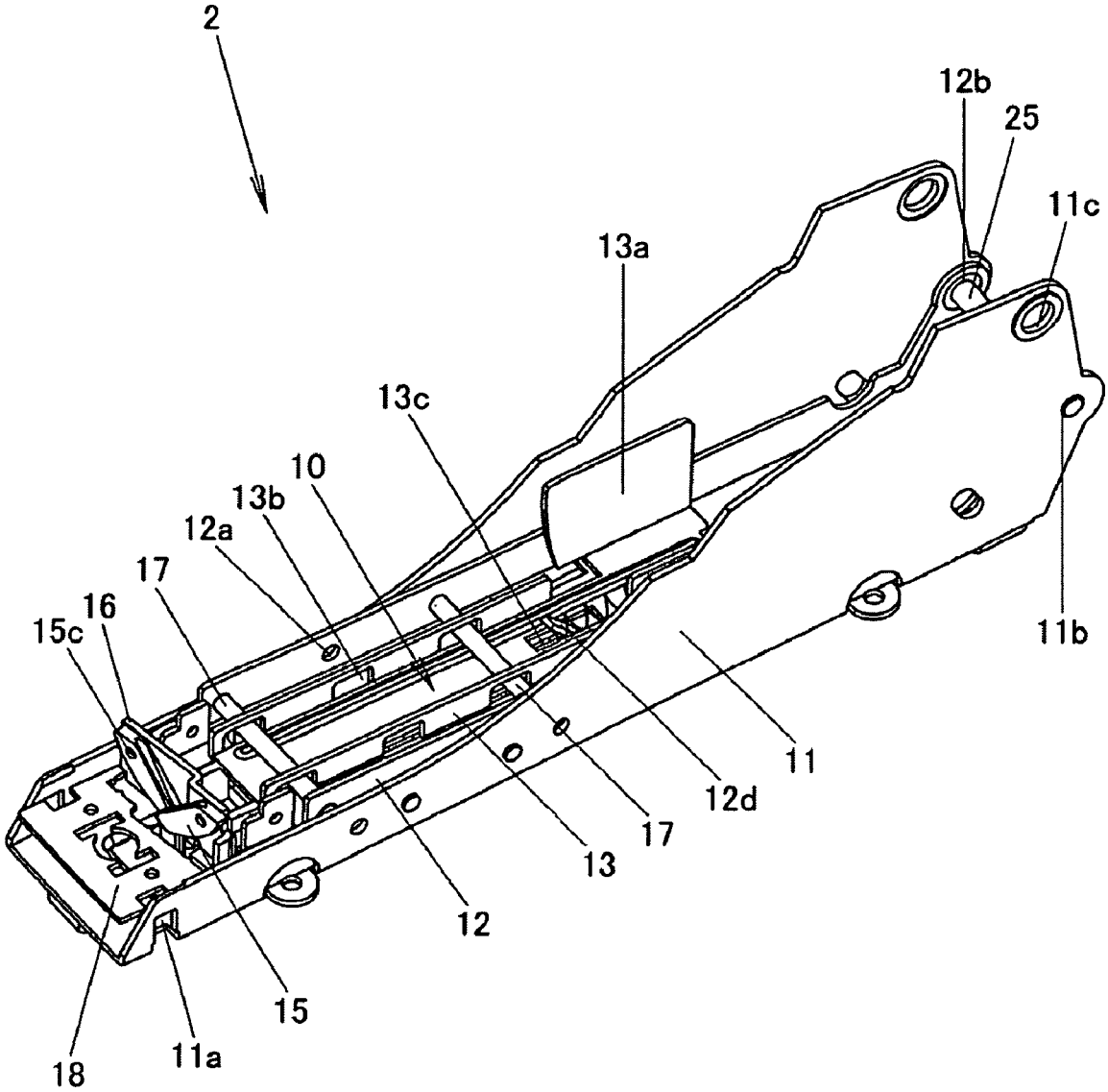
Figure 6:
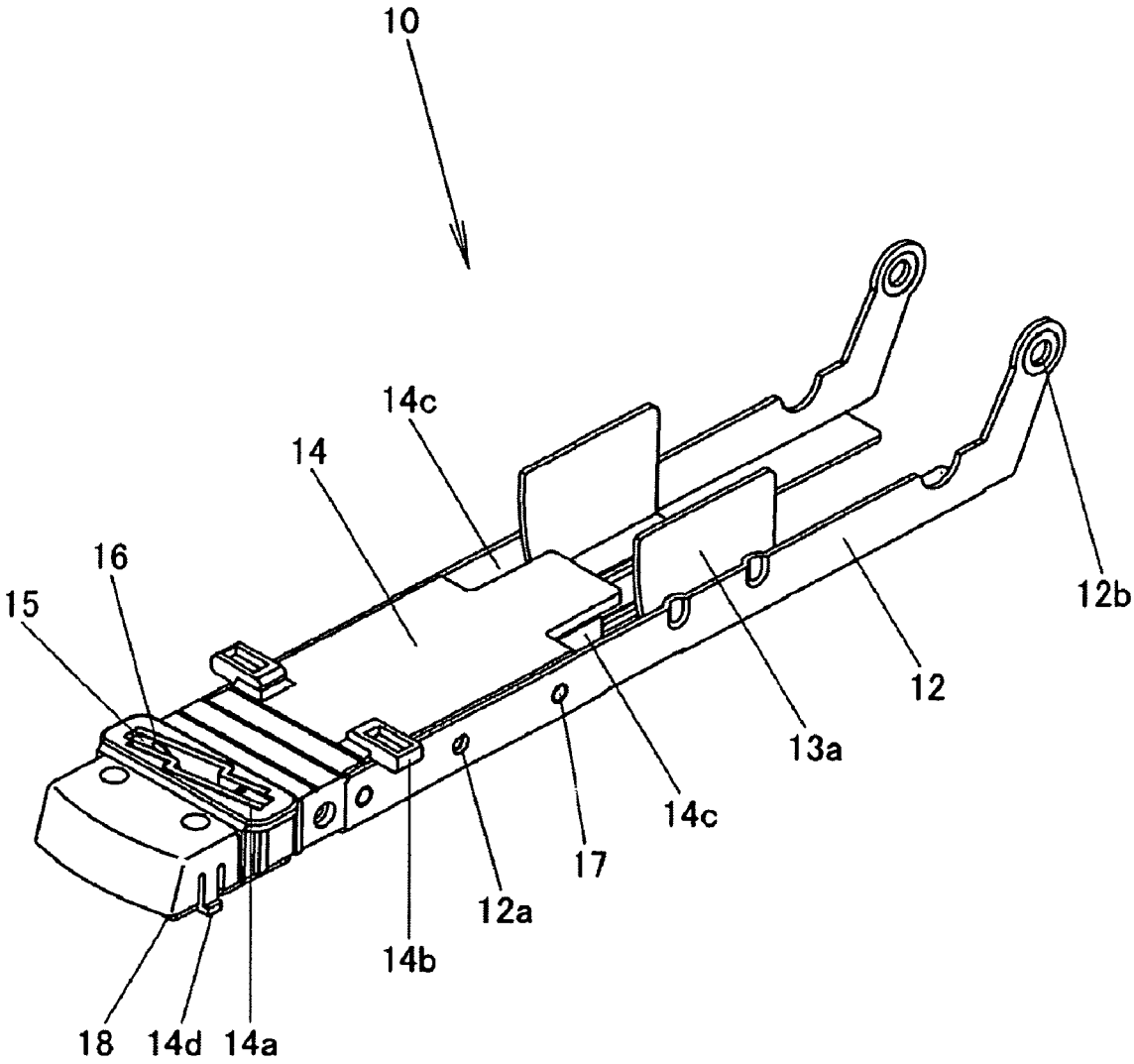
Figure 7:
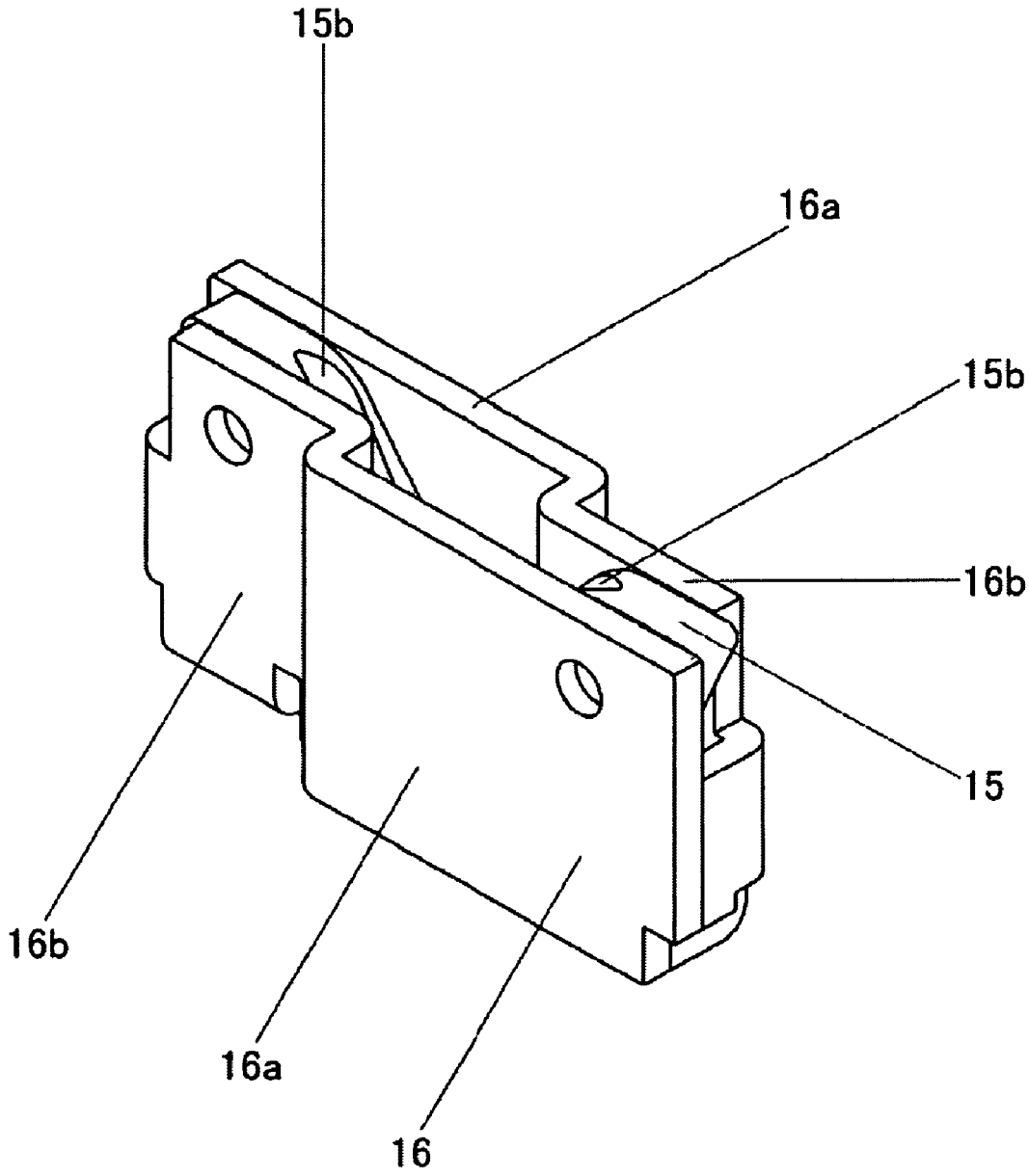
Figure 8:
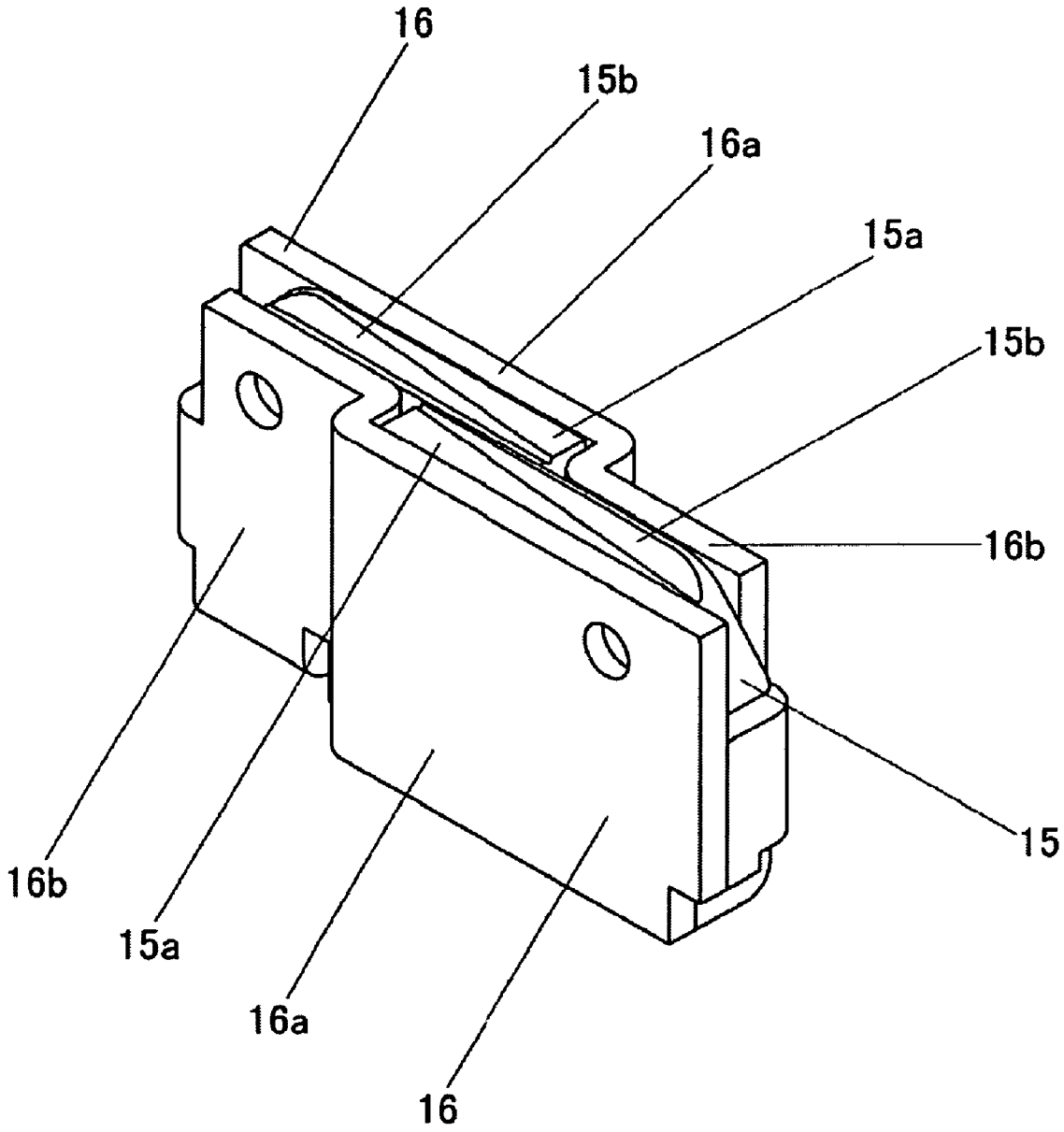
Figure 9:
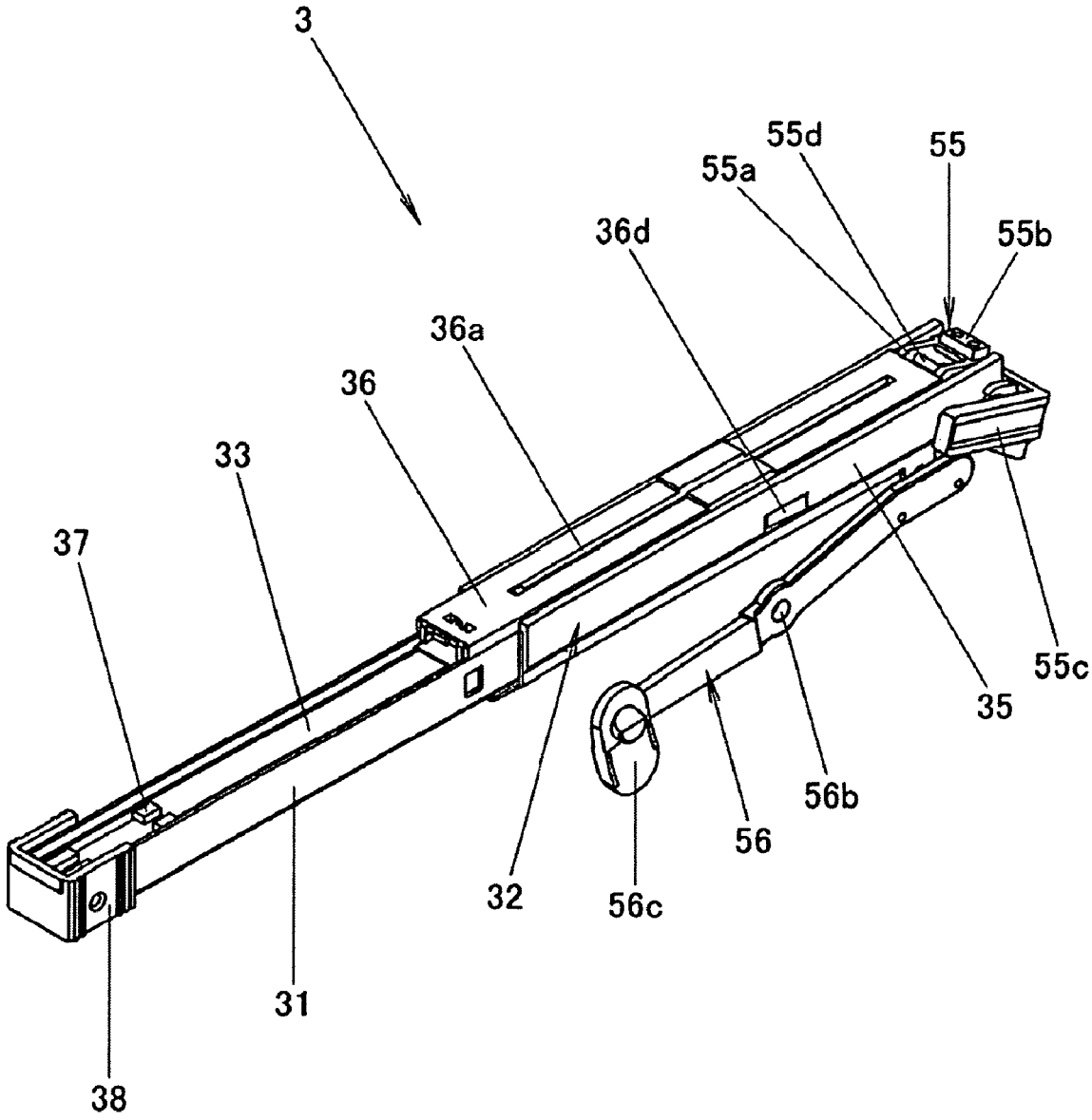
Figure 10:
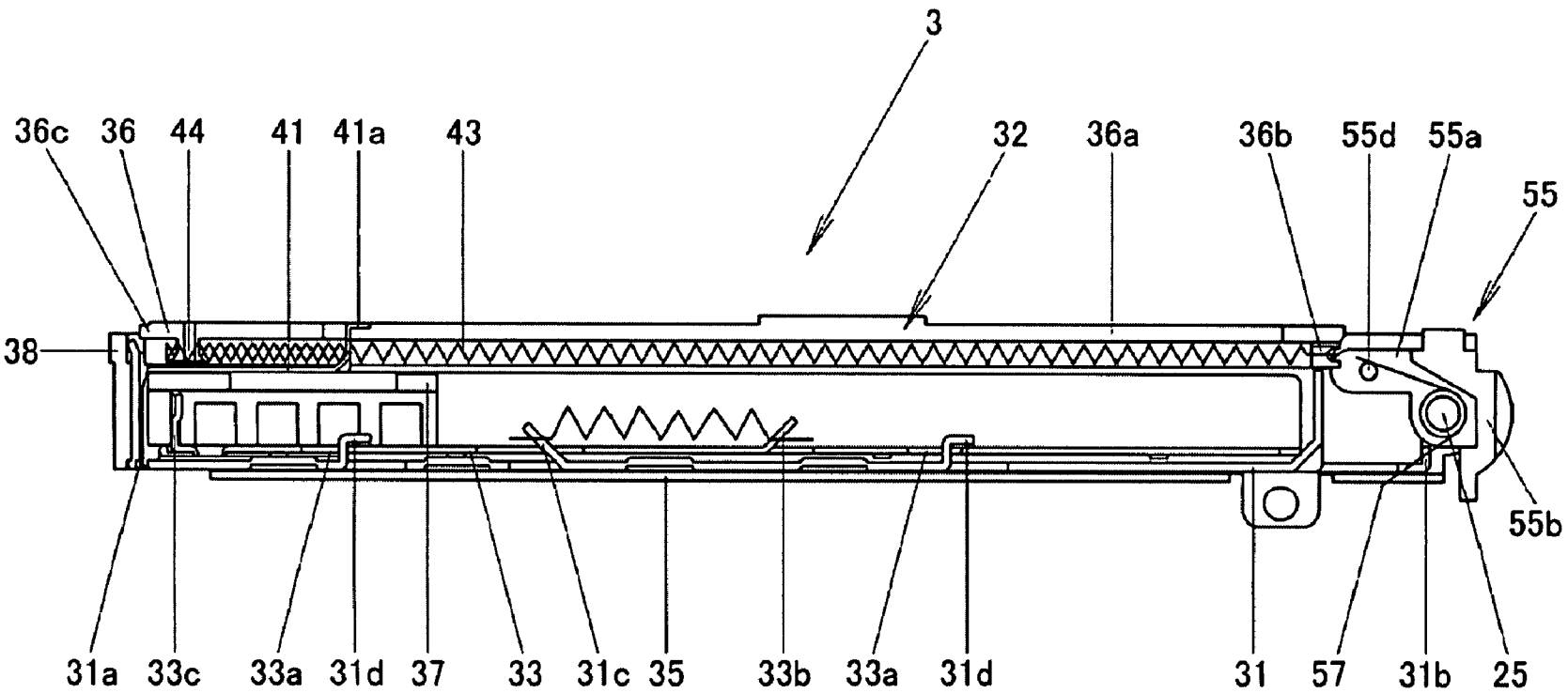
Figure 11:
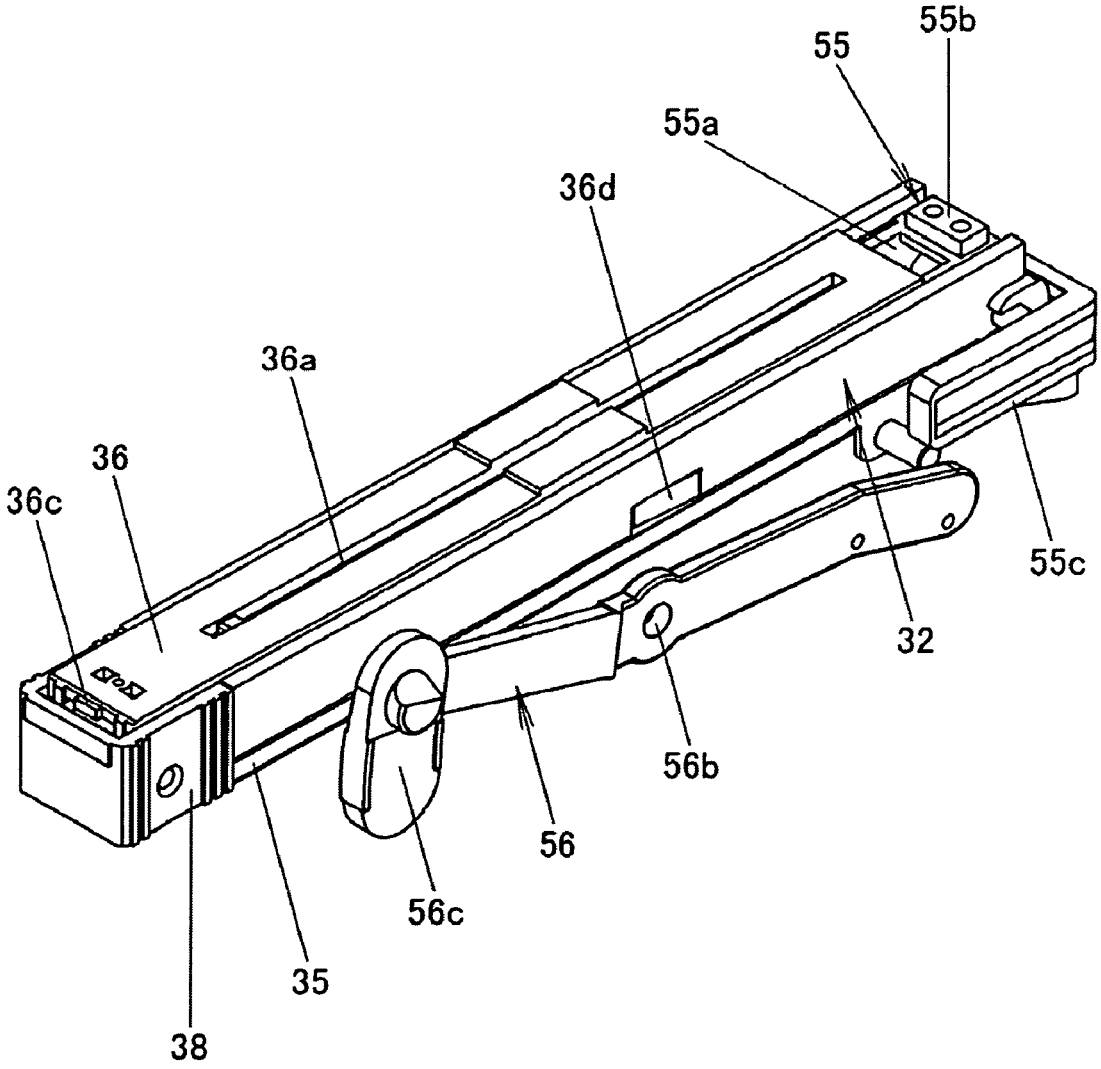
Figure 12:
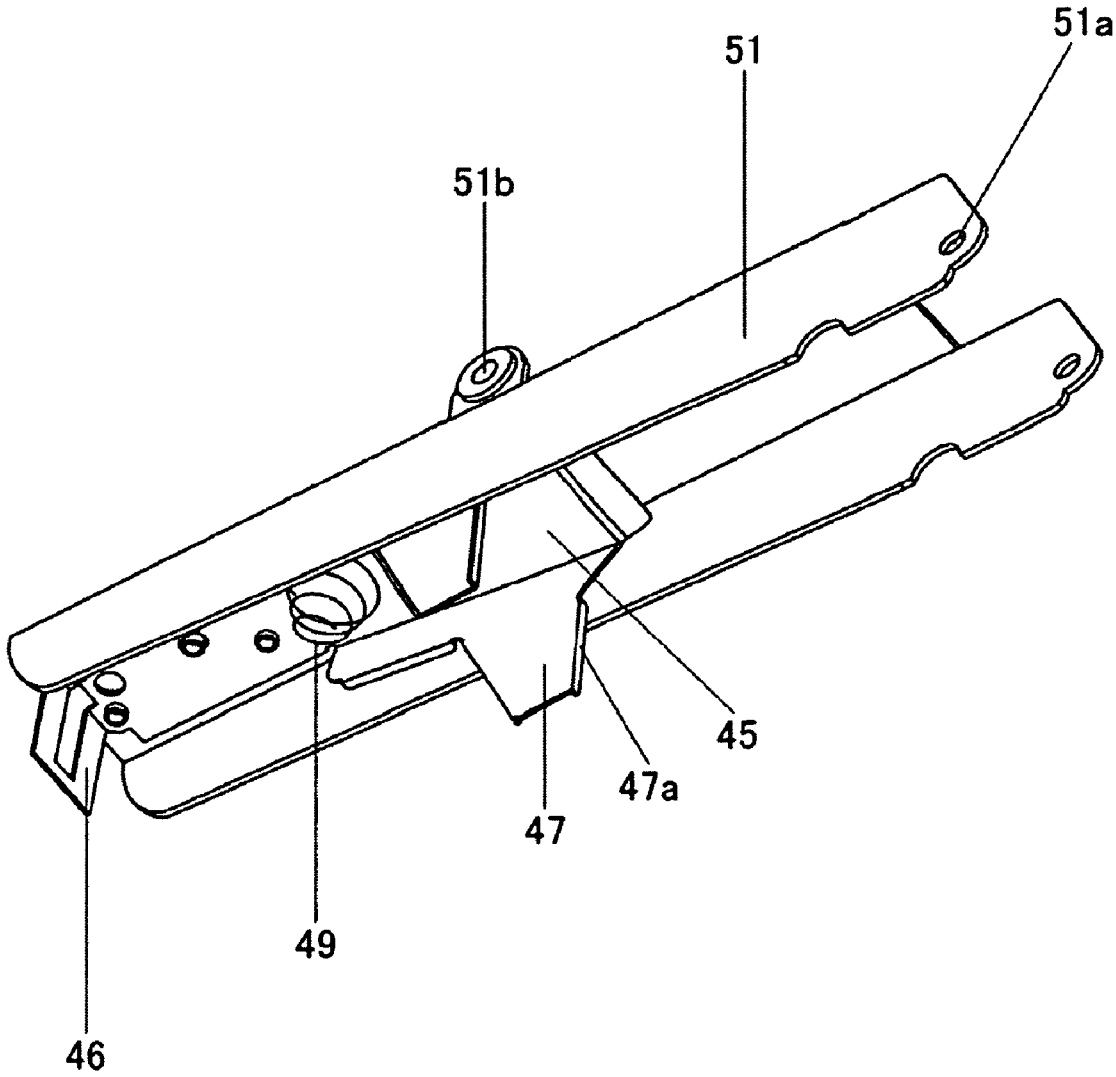
Figure 13:
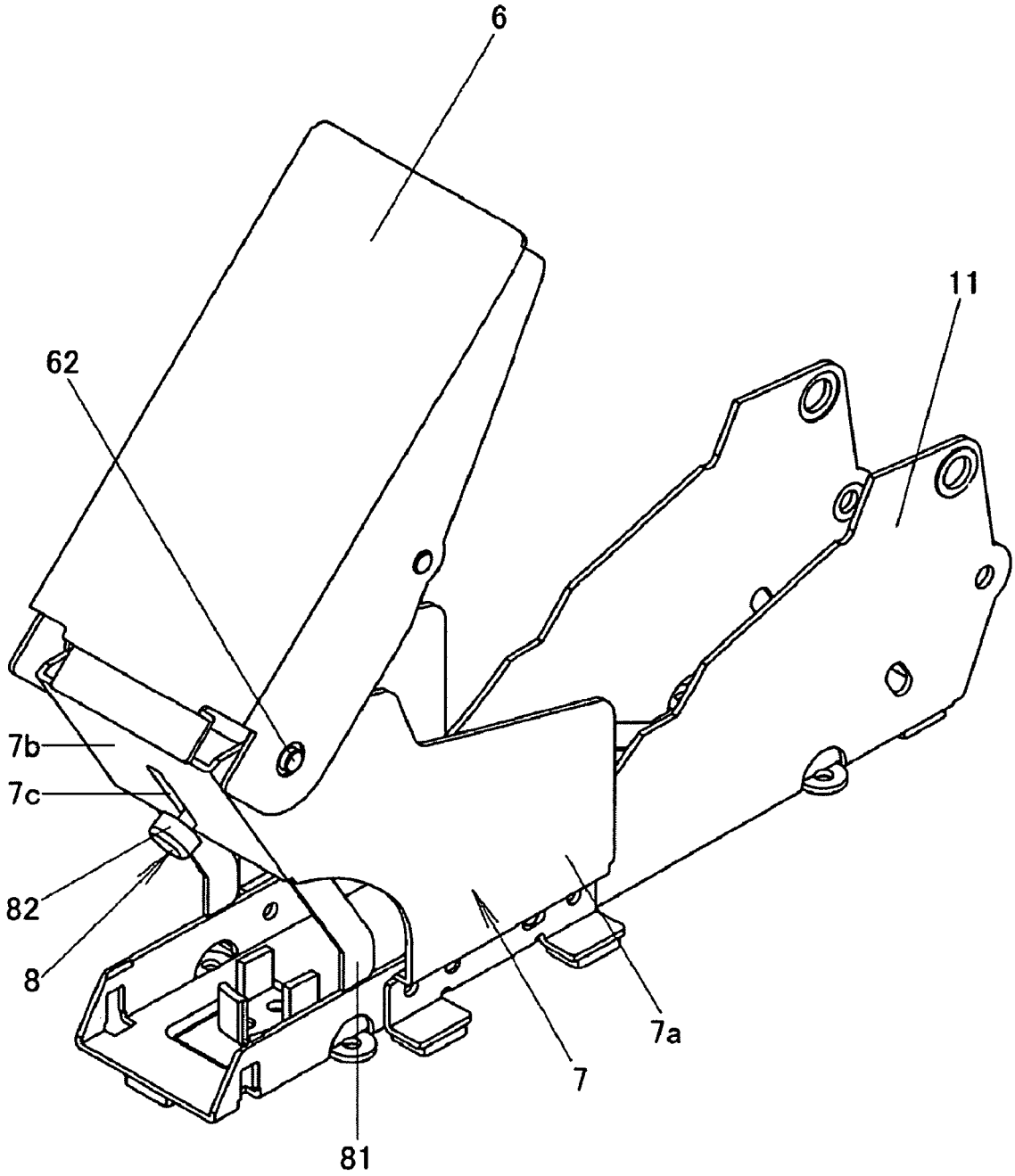

FIG. 1 is a perspective view of a stapler according to an embodiment of the invention, which results when the stapler is viewed from the left front thereof, and FIG. 2 is a perspective of the stapler according to the embodiment of the invention, which results when the stapler is viewed from the rear right thereof. In addition, FIG. 3 is a rear view of the stapler according to the embodiment of the invention, and FIG. 4 is a sectional view of the stapler according to the embodiment of the invention. Additionally, FIG. 5 is a perspective view of a base portion of the stapler according to the embodiment of the invention with some constituent members removed, FIG. 6 is a perspective view of a clinching portion of the stapler according to the embodiment of the invention, FIG. 7 is a perspective view of a movable clincher and a clincher holding member in such a state that the movable clincher is opened, FIG. 8 is a perspective view of the movable clincher and the clincher holding member in such a state that the movable clincher is closed, FIG. 9 is a perspective view of a magazine portion when a magazine main body projects therefrom, FIG. 10 is a sectional view of the magazine portion of the stapler according to the embodiment of the invention, FIG. 11 is a perspective view of the magazine portion of the stapler according to the embodiment of the invention, FIG. 12 is a perspective view of a first push-down member of the stapler according to the embodiment of the invention, and FIG. 13 is a perspective view of a handle member and a handle support member, and a pedestal member of the stapler according to the embodiment of the invention.

Figure 14:
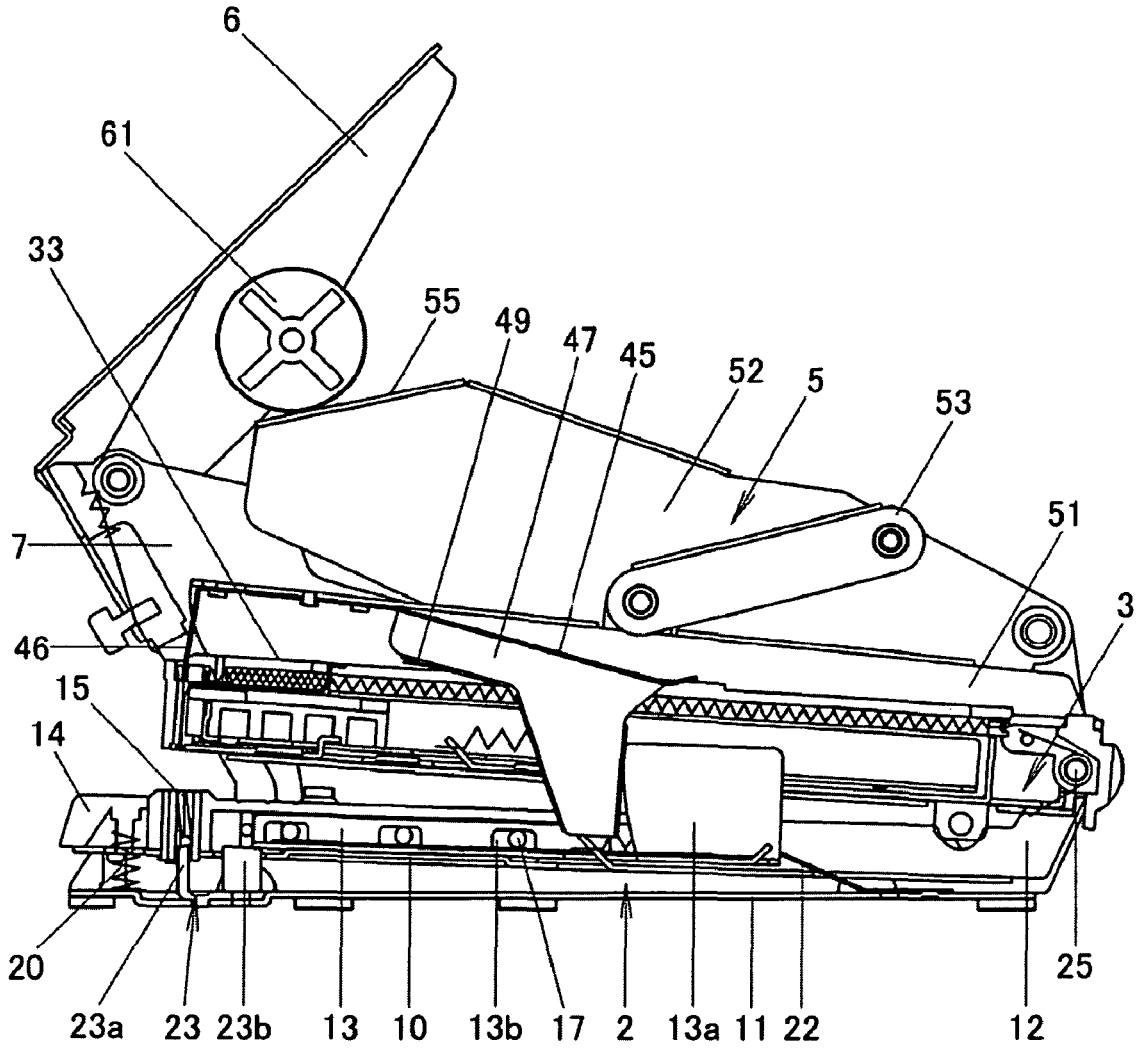
Figure 15:
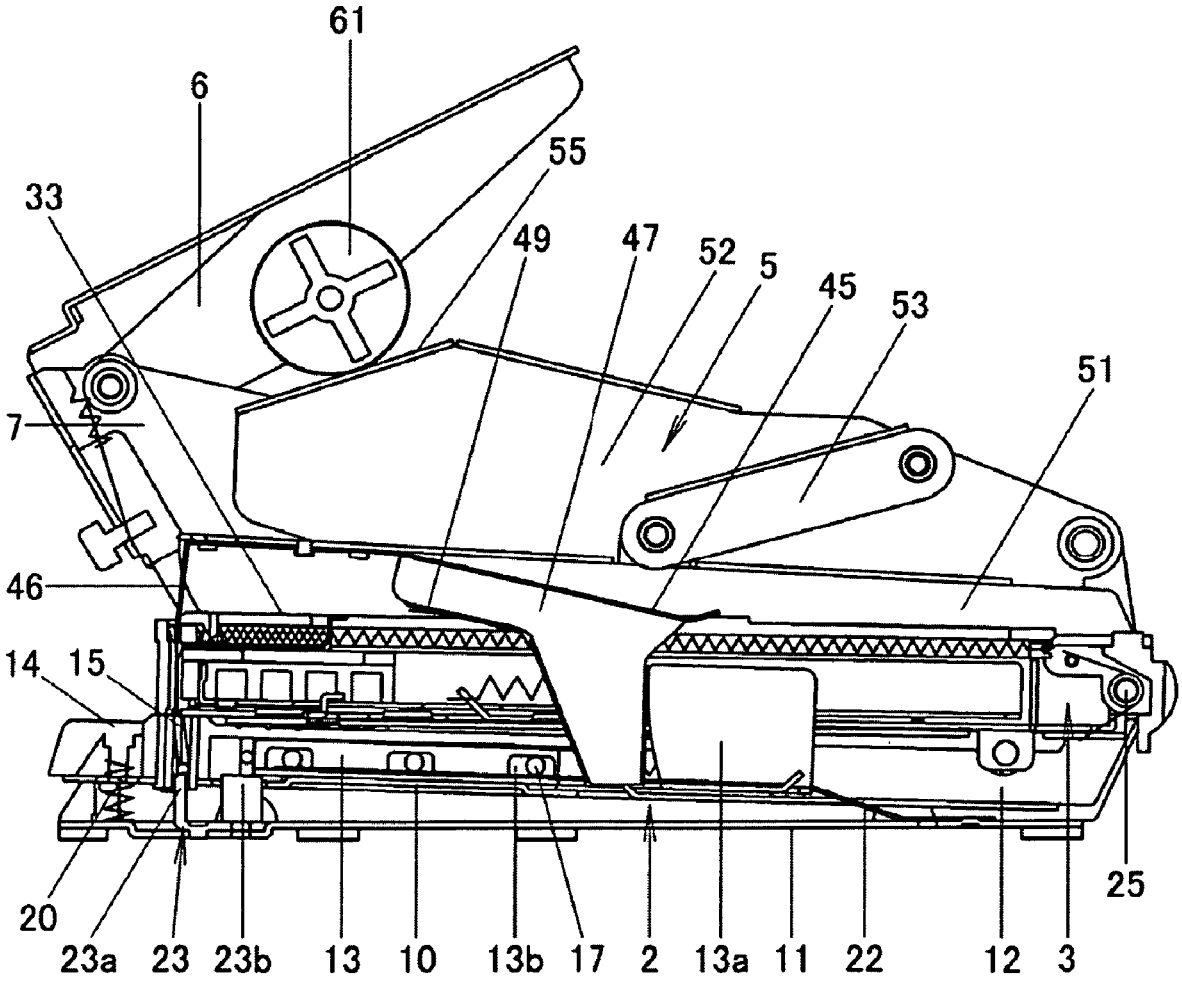
Figure 16:
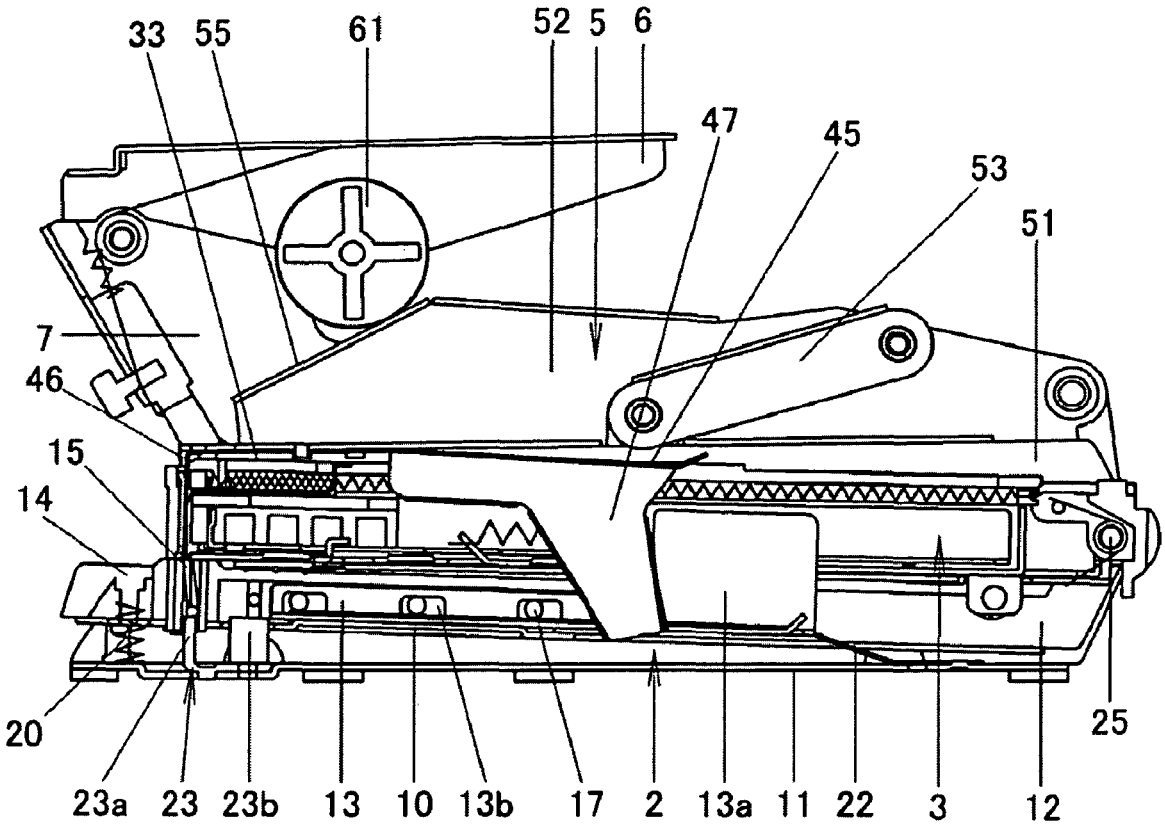
Figure 17:
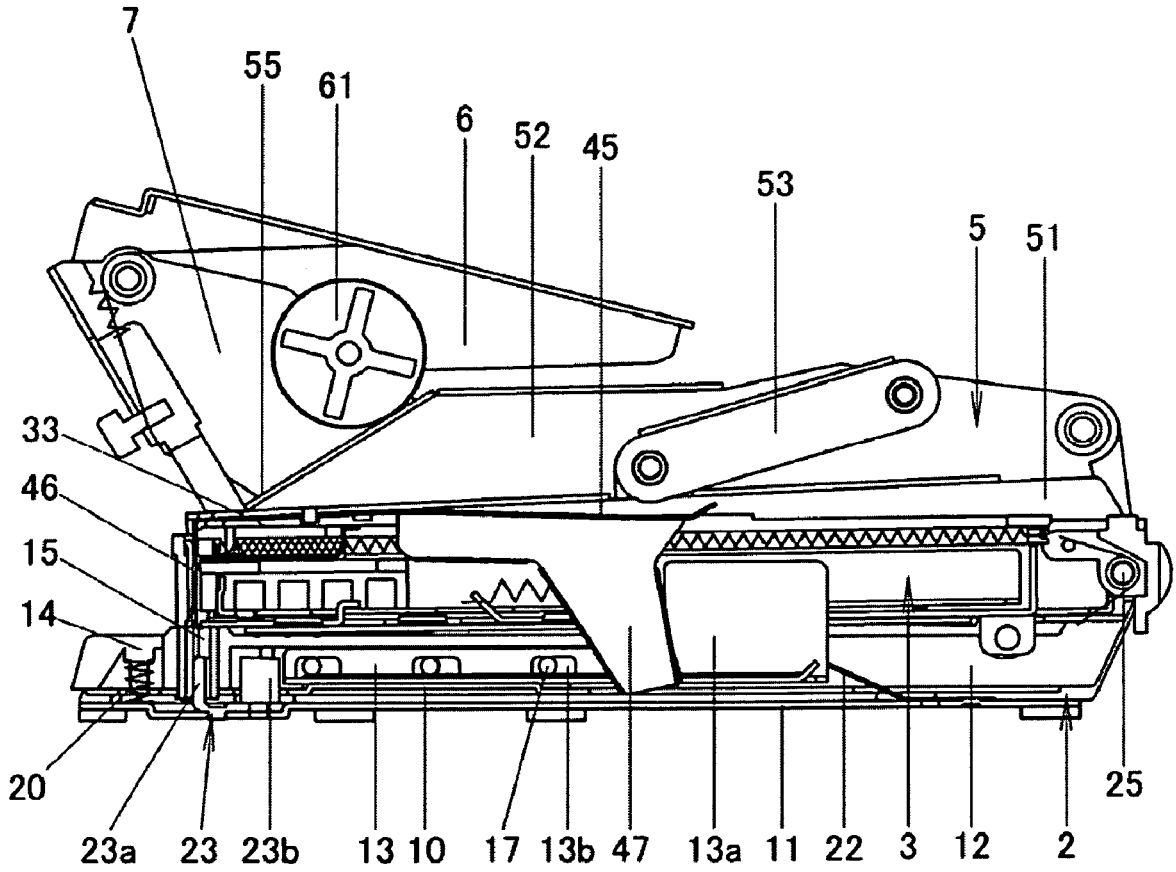

FIG. 14 is a sectional view illustrating the operation of the stapler according to the embodiment of the invention, FIG. 15 is a sectional view illustrating the operation of the stapler according to the embodiment of the invention, FIG. 16 is a sectional view illustrating the operation of the stapler according to the embodiment of the invention, and FIG. 17 is a sectional view illustrating the operation of the stapler according to the embodiment of the invention.

DESCRIPTION OF THE PREFERRED EMBODIMENT

A stapler 1 according to a best mode for carrying out the invention is such as to have a base portion 2 which includes a rotatable clinching portion 10, a magazine portion 3 which is pivotally attached to rotate to a position on the base portion 2 which lies in the vicinity of a rear end thereof by a spindle 25 and is disposed above the base portion 2, a push-down portion 5 which is pivotally attached to rotate to a position on the base portion 2 which lies in the vicinity of the rear end thereof, which has a driving blade 46 in the vicinity of a front end thereof and which is disposed above a magazine portion 3, and a handle member 6 which is pivotally attached to rotate to a handle support member 7 which is fixed to the base portion 2 at a portion which lies in the vicinity of a front end thereof and which is adapted to lower the push-down portion 5 by being brought into contact with the vicinity of a front end of an upper portion of the push-down portion 5.

In addition, the clinching portion 10 has a slider 13 which slides along sliding support shafts 17 to permit a lowering operation of the clinching portion 10 and the handle member 6 includes a roller 61 in a position which is in contact with the push-down portion 5. This handle member 6 is such as to lower the push-down portion 5 based on the principle of leverage in which the portion where the handle member 6 is pivotally attached to the handle support member 7 acts as a fulcrum, a rear end portion of the handle member 6 acts as a point of effort, and a contact point of the handle member 6 with the push-down portion 5 acts as a point of application.

In addition, the magazine portion 3 is of a front loading type which includes a slidable magazine main body 31, a magazine accommodating portion 32 for accommodating the magazine main body 31, and a magazine main body locking mechanism, and the magazine main body locking mechanism has a rotatable rear end locking member 55 for locking or releasing a rear end of the magazine main body 31 and a rotating arm 56 for controlling the rotation of the rear end locking member 55.

Furthermore, the handle support member 7 includes a paper holding mechanism 8 which is made up of a paper stopper member 81 and a control member 82. The paper stopper member 81 of the paper holding mechanism 8 is made up of a two side plates which are disposed in such a manner as to oppositely face each other and a connecting plate which connects together the side plates near to upper ends thereof, and each of the two oppositely disposed plates has an inclined portion and a vertical portion. The paper stopper member 81 is disposed inside the handle support member 7 in such a manner that a front wall 7*b* of the handle support member 7 and the connecting plate of the paper stopper member 81 oppositely face each other. The control member 82 of the paper holding mechanism 8 penetrates through a siding hole 7*c* formed in the front wall 7*b* of the handle support member 7 from an outside to be connected to the connecting plate of the paper stopper member 81, so as to move the paper stopper member 81 vertically by control member 82 being caused to slide along the sliding hole 7*c*.

In addition, the driving blade 46 is formed integrally with a leaf spring 45 which includes slider pushing portions 47 which lock on the slider 13. The slider 13 includes sliding support portions 13*a* which are locked by the slider pushing portions 47, and a surface of each of the sliding support portions 13*a* which are locked by the slider pushing portions 47 is formed into a curved surface which matches the thickness of sheets of paper to be fastened together.

An embodiment of the invention will be described based on the drawings. As is shown in FIGS. 1 to 3, a stapler 1 of the embodiment is a desktop stapler of a flat type for fastening together a batch of sheets of paper from 2 to on the order of 60 sheets and includes a base portion 2 which has a rotatable clinching portion 10, a magazine portion 3 of a front loading type which is disposed above the base portion 2, a push-down portion 5 which is disposed above the magazine portion 3 and a handle member 6 which is pivotally attached to rotate to a handle support member 7 in a position which lies in the vicinity of a front end of the push-down portion 5.

In addition, the magazine portion 3 and the push-down portion 5 of the stapler 1 are pivotally attached to rotate to a position on the base member 2 which lies in the vicinity of a rear end of the base portion 2. The handle member 6 lowers the push-down portion 5 based on the principle of leverage in which a portion of the handle member 6 which is pivotally attached to the handle support member 7 acts as a fulcrum, a rear end portion of the handle member 6 acts as a point of effort and a contact point of the handle member 6 with the push-down member 5 acts as a point of application. In addition, the handle member 6 includes a roller 61 at the point of application.

Furthermore, as is shown in FIG. 4, the stapler 1 has a leaf spring 45 having a driving blade 46 between the magazine portion 3 and the push-down portion. In addition, when the push-down portion 5 lowers, a slider pushing portion 47, which is provided in such a manner as to extend downwards from the leaf spring 45, causes the slider 13 provided on the clinching portion 10 provided, in turn, on the base portion 2 to slide to the rear. Then, the clinching portion 10 is allowed to lower by the slider 13 being caused to slide rearwards, a staple is clinched between the driving blade 46 and a movable clincher 15 so that pointed ends of the staple are bent horizontally.

The base portion 2 is made up of a pedestal member 11 which constitutes a pedestal of the stapler 1 and the clinching portion 10 which is pivotally attached to rotate about a position on the pedestal member 11 which lies in the vicinity of a rear end thereof as an axis.

This pedestal member 11 is a member which constitute a base of the stapler 1 of the embodiment, and the magazine portion 3 and the push-down portion 5 are pivotally attached to rotate to a position on the pedestal member 11 which lies in the vicinity of the rear end thereof. In addition, as is shown in FIG. 5, the pedestal member 11 is made up of a narrow and long rectangular flat plate and side walls which rise vertically from side ridge portions of the flat plate, respectively.

The side walls of the pedestal member 11 are formed in such a manner that they are tall at their rear ends and become lower in height as they extend towards distal ends thereof and each have a screw locking hole 11*a* in the vicinity of a front end and a shaft hole 11*b* and an attaching portion 11*c* in the vicinity of a rear end thereof. As is shown in FIG. 1, stopping claws 14*d* of a table 14, which will be described later, are inserted and passed through the screw locking holes 11*a*, and as is shown in FIG. 5, the spindle 25 which pivotally attaches the clinching portion 10 is inserted and passed through the shaft holes 11*b* . In addition, a second push-down member 52, which will be described later, is attached in place in the attaching portions 11*c*.

In addition, as is shown in FIG. 4, a locking member 23 is fixed to a position on the rectangular flat plate of the pedestal member 11 which lies in the vicinity of a front end thereof. The locking member 23 is made up of clincher locking portions 23*a* which project upwards, respectively, from front end portions of the side ridge portions of the rectangular flat plate and slider locking portions 23*b* which projects vertically from portions of the side ridge portions of the flat plate which lie closer to the rear end of the flat plate, respectively. In addition, the clincher locking portions 23*a* lock a movable clincher 15, which will be described later, and rotate the movable clincher 15 upwards from therebelow. The slider locking portions 23*b* lock the slider 13 so as to prevent the lowering of the clinching portion 10 and permits the lowering operation of the clinching portion 10 as a result of a locked state between the slider locking portions 23*b* and the slider being released when the slider 13 moves backwards. Furthermore, a first biasing spring 20 is attached to a position of the flat plate of the pedestal member 11 which lies in the vicinity of a distal end portion thereof, and a second biasing spring 22 is attached to a position of the flat plate which lies in the vicinity of a rear portion thereof.

As is shown in FIGS. 4 and 5, the clinching portion 10 includes a slider holding member 12 which is pivotally attached to rotate to the pedestal member 11 by the spindle 25, the slider 13 which is disposed slidably on the slider holding member 12 in such a manner as to slide back and forth, the table 14 which is fitted in the slider holding member 12, the movable clincher 15 which is disposed in a position on the slider holding member 12 which lies in the vicinity of a distal end thereof and a clincher holding member 16 for holding the movable clincher 15 and a table distal end cover member 18 which is fixed to a distal end of the slider holding member 12.

As is shown in FIG. 6, the slider holding member 12 is such that the slider 13 and the table 14 are disposed thereon and is made up of a narrow and long rectangular flat plate and side walls which rise vertically from side ridge portions of the flat plate. The slider holding member 12 is pivotally attached to the pedestal member 11 at a rear end thereof by the spindle 25. In addition, side walls of the slider holding member 12 are formed in such a manner that rear ends thereof are inclined upwardly rearwards and each have a plurality of shaft fixing holes 12*a* in an area ranging from the vicinity of a front end to the vicinity of a center thereof and a shaft hole 12*b* in the vicinity of the rear end thereof. Sliding support shafts 17, which will be described later, are inserted and passed through the shaft fixing holes 12*a* so formed, and the spindle 25 is inserted and passed through the shaft hole 12*b*.

In addition, the slider holding member 12 has penetrating insertion holes in the vicinity of a distal end of the flat plate and a spring attaching projection 12*d* in the vicinity of the rear end of the flat plate. As is shown in FIG. 4, the slider locking portions 23*b* of the locking member 23 which is fixed to the pedestal member 11 are inserted and passed through the penetrating insertion holes so formed. A tension spring is attached in such a manner as to extend between the spring attaching projection 12*d* and a spring attaching projection 13*b* of the slider 13, which will be described later.

The slider 13 permits the lowering operation of the clinching portion 10, and as is shown in FIG. 5, the slider 13 is made up of a narrow and long rectangular flat plate, side walls which rise vertically from side ridge portions of the flat plate and sliding support portions 13*a* which rise vertically from the side ridge portions of the flat plate in positions lying in the vicinity of rear ends of the side walls. In addition, the flat plate of the slider 13 is formed wider on a rear end side where the sliding support portions 13*a* are formed than a front end side where the side walls are formed, and hence, the sliding support portions 13*a* are situated further transversely outwards than the side walls. The reason the flat plate is made wider in the position where the sliding support portions 13*a* are formed in the way described above is that the sliding support portions 13*a* are brought into locking engagement with slider pushing portions 47, which are positioned transversely outwards of the side walls, of a leaf spring 45, which will be described later.

In addition, a front end face of the sliding support member 13*a* with which the slider pushing portion 47, which will be described later, is brought into locking engagement is formed into a curved surface which matches the thickness of sheets of paper to be fastened together. The reason the front end face of the sliding support member 13*a* is formed into the curved surface is that the stapler 1 of this embodiment is made to fasten or staple a batch of sheets of paper ranging from 2 to 60 sheets and that since the thickness of a batch of sheets of paper to be placed on the table 14 changes largely, in order to have substantially the same clinching timing irrespective of the thickness of sheets of paper to be placed on the table 14, the timing at which the slider pushing portions 47 push the slider 13 to cause it to slide rearwards needs to remain the same irrespective of the thickness of sheets of paper to be placed on the table 14. Consequently, the front end face of the sliding support portion 13*a* is formed into the curved surface which is associated with a difference in timing at which the slider pushing portions 47 move rearwards which is caused by a change in thickness of a batch of sheets of paper to be placed on the table 14.

In addition, the slider 13 has a penetrating insertion hole 13*c* in the vicinity of a rear end of the flat plate and includes a plurality of longitudinally long shaft moving holes 13*b* in the side walls from the vicinities of front ends to centers of the side walls. The spring attaching projection 12*d* of the slider holding member 12 is inserted and passed through the penetrating insertion hole 13*c*, and the sliding support shafts 17 are inserted and passed through the shaft moving holes 13*b*, and a longitudinal length of the shaft moving hole 13*b* substantially coincides with a distance over which the slider 13 is allowed to slide.

The reason the sliding support shafts 17 are made to inserted and passed through the shaft moving holes 13*b* is that since the stapler 1 of the embodiment is of the desktop type, the stapler 1 is large in size, compared with the hand-held stapler, and that in the case of a large stapler like that, since the sliding distance of the slider 13 is increased, the slider 13 is prevented from being inclined while it is sliding and the sliding operation is prevented from becoming too heavy to be performed due to friction produced between the flat plate of the slider 13 and the table 14. Namely, by the sliding support shafts 17 being inserted and passed through the slider 13 so that the slider 13 slides on the sliding support shafts 17, the slider 13 is prevented from being inclined when it is sliding, and the production of friction between the flat plate of the slider 13 and the table 14 can be suppressed due to a gap being produced therebetween.

Furthermore, as is shown in FIG. 4, the spring attaching projection 13*d* is formed on the flat plate of the slider 13 in a position lying in the vicinity of a rear end thereof. In addition, the tension spring is attached in such a manner as to extend between the spring attaching projection 13*d* and the spring attaching projection 12*d* of the slider holding member 12, so as to bias the slider 13 forwards.

In addition, the slider locking portions 23*b* of the locking member 23 are brought into contact with a lower surface of the flat plate of the slider 13, and a lowering operation of the clinching portion 10 is prevented due to the contact of the slider 13 with the slider locking portions 23*b* . Additionally, when the slider 13 slides rearwards and a front end of the flat plate moves further rearwards than the slider locking portions 23*b* of the slider locking member 23, the holding of the lowering operation of the slider 13 is released, whereby the clinching portion 10 is allowed to lower.

Sheets of paper are placed on the table 14 for fastening, and as is shown in FIG. 6, the table 14 is fitted in the slider holding member 12. In addition, the table 14 is made up of a rectangular flat plate, a front wall which is formed in such a manner as to extend obliquely downwards and forwards from a front end ridge portion of the flat plate and side walls which extend downwards vertically from portions of side ridge portions which lie in the vicinity of the front end of the flat plate.

In addition, the table 14 has a clincher surrounding portion 14*a* in the vicinity of a distal end of the flat plate, stopping projections 14*b* in the vicinity of the rear of the clincher surrounding portion 14*a*, cutouts 14*c* in the vicinity of a rear end thereof and a spring attaching projection, not shown, on a rear surface in the vicinity of a distal end portion thereof. The clincher surrounding portion 14*a* is an opening which has substantially the same shape as an external shape of the clincher holding member 16 which holds movable clincher 15, so that a portion of the clincher holding member 16 which lies in the vicinity of an upper end thereof is fitted therein. Additionally, the stopping projections 14*b* are brought into locking engagement with upper ends of the side walls of the pedestal member 11 when the clinching portion 10 performs a lowering operation so as to stop the lowering operation. Furthermore, the slider pushing portions 47 of the leaf spring 45, which will be described later, are fitted in the cutouts 14*c*, and an end portion of the first biasing spring 20 shown in FIG. 4 is fixed to the spring attaching projection.

Furthermore, the stopping claws 14*d* are screwed to positions on the side walls of the table 14 which lie in the vicinity of front ends thereof, and as is shown in FIGS. 1 and 2, these stopping claws 14*d* are inserted and passed through the screw locking holes 11*a* of the pedestal member 11, so that when the clinching portion 10 is rotated upwards by the first biasing spring 20, the stopping claws 14*d* are brought into locking engagement with upper ends of the screw locking holes 11*a* to thereby the upward rotation of the clinching portion 10 is stopped.

As is shown in FIG. 6, the movable clincher 15 is disposed in the clincher surrounding portion 14*a* of the table 14 in such a state that the rotatable clincher 15 is pivotally attached to rotate to the clincher holding member 16 and is made up of two thick, narrow substantially rectangular clinching members. As is shown in FIGS. 7 and 8, this clinching member has a pressing surface 15*a* on which a rail 15*b* is formed and as is shown in FIG. 5, a shaft hole 15*c* is provided on a surface which intersects the pressing surface 15*a* at right angles in a position which lies in the vicinity of an upper end of the surface.

In addition, the rail 15*b* of the clinching member is formed to bend distal ends of a staple along the rail 15*b* when the distal ends of the staple are pressed against the rail 15*b* . The shaft hole 15*c* is used when the movable clincher 15 is pivotally attached to the clincher holding member 16. Additionally, since the slider 13 is locked by the slider locking portions 23*b* of the locking member 23, when the clinching portion 10 is in such a state that the clinching portion 10 is prevented from rotating, the movable clincher 15 is accommodated in an interior of the clincher holding member 16 as is shown in FIG. 7. On the other hand, when the locked engagement of the slider 13 with the slider locking portions 23*b* of the locking member 23 is released so that the clinching portion 10 is allowed to lower, the movable clincher 15 is pushed up by the clincher locking portions 23*a* of stopping member 23 at a lower portion thereof, whereby, as is shown in FIG. 8, the movable clincher 15 rotates in the interior of the clincher holding member 16, whereby the pressing surface 15*a* is made horizontal.

The clincher holding member 16 is made up of two plates which each have a laterally-wide wide portion 16*a* and a laterally-narrow narrow portion 16*b* and a hook-like cross section. The two plates are disposed in such a manner that the wide portion 16*a* of one of the plates oppositely faces the narrow portion 16*b* of the other plate, and the movable clincher 15 is pivotally attached in place between the two plates. A width of the wide portion 16*a* is made to coincide substantially with a longitudinal length of the pressing surface 15*a* of the movable clincher 15, and the movable clincher 15 is pivotally attached to the clincher holding member 16 in such a manner that portions lying near distal end portions of surfaces which intersect the pressing surfaces 15*a* are overlapped each other with distal end portions of the two clinching members being prevented from hitting each other even when the two clinching members rotate abut their associated shafts.

As is shown in FIG. 5, the table distal end cover member 18 is made up of a flat plate which has an opening, and as is shown in FIG. 4, the first biasing spring 20 is inserted and passed through this opening. In addition, this table distal end cover member 18 is disposed a distal end of the slider holding member 12, so as to cover a rear surface side of a portion of the table 14 which lies in the vicinity of a distal end portion of the table 14.

As is shown in FIG. 4, the first biasing spring 20 is a pusher spring which is fixed to a position on the flat plate of the pedestal member 11 which lies in the vicinity of the front end of the flat plate at one end of the same spring and is inserted and passed through the opening in the table distal end cover member 18 so as to be fixed to the spring attaching projection on the table 14 at the other end of the spring. This first biasing spring 20 not only biases the clinching portion 10 upwards but also absorbs impact produced when the clinching portion 10 lowers.

The second biasing spring 22 is a leaf spring which is fixed to a position on the flat plate of the pedestal member 11 which lies in the vicinity of the rear end of the flat plate at one end of the same spring and is pivotally attached to a rear surface of a magazine main body 31, which will be described later, at the other end of the spring. This second biasing spring 22 biases the magazine portion 3 upwards.

In addition, as is shown in FIG. 9, the magazine portion 3 of the embodiment includes the slidable magazine main body 31, a magazine accommodating portion 32 which accommodates therein the magazine main body 31 and a magazine main body locking mechanism which locks or releases a rear end of the magazine main body 31. In addition, this magazine portion 3 is of a front loading type in which the magazine main body 31 can be pulled out from a front thereof when staples are loaded in the magazine portion 3.

The magazine main body 31 includes a narrow rectangular flat plate which is formed slightly wider than the width of staples to be loaded, side walls which rise vertically from side ridge portions of the flat plate, a front wall which is formed by bending distal end portions of the side walls inwards substantially at right angles, and a rear wall which is formed by erecting vertically a U-shaped cut portion formed in a position on the flat plate which lies in the vicinity of a rear end thereof. In addition, openings are formed in the side walls of the magazine main body 31 in positions which lie near centers of the respective side walls in such a manner that stoppers 36*d* on a magazine lid 36, which will be described later, are brought into locking engagement with the openings, respectively.

Additionally, as is shown in FIG. 10, the magazine main body 31 has a driving port 31*a* which is defined between the front end of the flat plate and the front wall and a rear end locking projection 31*b* which is formed by erecting vertically the rear end of the flat plate. The driving port 31*a* constitutes a hole through which staples accommodated in the magazine main body 31 pass when the staples are driven downwards by the driving blade 46, and a rear end locking member 55, which will be described later, is brought into locking engagement with the rear end locking projection 31*b*. Furthermore, a grip member 38 is attached to a front end of the magazine main body 31 in such a manner as to be griped when the magazine main body 31 is pulled out of the magazine accommodating portion 32.

Furthermore, the magazine main body 31 includes a fixing claw 31*d* and spring locking projections 31*c* on the flat plate. The fixing claw 31*d* is inserted and passed through a penetrating insertion hole 33*a* which is formed in a flat plate of a sliding assist member 33, which will be described later, and a tension spring is attached between the spring locking projection 31*c* and a spring locking projection 33*b* of the sliding assist member 33. In addition, the magazine main body 31 includes shaft holes formed in the side walls in positions near the rear ends thereof, so as to be pivotally attached to rotate to the pedestal member 11 by the spindle 25.

The sliding assist member 33 assists staples accommodated within the magazine main body 31 and a staple pushing member 41 possessed by a staple pushing mechanism to slide. In addition, the sliding assist member 33 is made up of the narrow rectangular flat plate having a width which is slightly smaller than the width of the staples, side walls which rise vertically from ridge portions of the flat plate and front locking wall 33*c* which rises vertically from a front end of the flat plate.

Additionally, the sliding assist member 33 has penetrating insertion holes 33*a* and a spring locking projection 33*b* on the flat plate. The fixing claw 31*d* formed on the flat plate of the magazine main body 31 is inserted and passed through the penetrating insertion hole 33*a*, and one end of the tension spring is attached to the spring locking projection 33*b*. Furthermore, a sliding knob 37 that is mounted on a front locking wall 33*c* is fixed to the vicinity of a distal end portion of the sliding assist member 33.

In addition, the sliding assist member 33 is disposed in such a manner that the flat plate of the sliding assist member 33 is overlapped on the flat plate of the magazine main body 31, whereby the fixing claws 31*d* of the magazine main body 31 are inserted and passed through the penetrating insertion holes 33*a*, and a tension spring is attached to the spring locking projections 31*c*, 33*b* of the magazine main body 31 and the sliding assist member 33, respectively. Additionally, gaps are formed between the side walls of the magazine main body 31 and the side walls of the sliding assist member 33, respectively, and by legs of staples and side walls of the staple pushing member 41 being fitted in the gaps, the staples and the staple pushing member 41 are allowed to slide along the sliding assist member 33. The staple pushing member 41 will be described in detail later.

The sliding assist member 33 is allowed to slightly slide because a play exists between the fixing claws 31*d* and the penetrating insertion holes 33*a*, and by moving the sliding knob 37 back and forth a staple jammed in the driving port 31*a* can be removed, while the sliding assist member 33 is made stationary at normal times due to the tension spring being provided in such a manner as to extend between the spring locking projections 31*c*, 33*b*.

As is shown in FIG. 11, the magazine accommodating portion 32 is made up of a magazine receiving member 35 on which the magazine main body 31 slides and the magazine lid 36 in which the magazine receiving member 35 is fitted, and a staple pushing mechanism is provided in a space surrounded by the magazine receiving member 35 and the magazine lid 36. This staple pushing mechanism pushes a staple accommodated in the magazine main body 31 against the front end of the magazine main body 31.

The magazine receiving member 35 has a narrow rectangular flat plate and side walls which rise vertically from side ridge portion of the flat plate, and a front end of the flat plate is formed in such a manner as to project further forwards than front ends of the side walls. In addition, the side walls have shaft holes near rear ends thereof and are pivotally attached to rotate to the pedestal member 11. Furthermore, openings are provided in the side walls in positions near centers thereof in such a manner that the stoppers 36*d* of the magazine lid 36 are inserted and passed therethrough.

The magazine lid 36 has a narrow rectangular flat plate and side walls which are suspended vertically from side ridge portions of the flat plate. Rear ends of the side walls are formed in such a manner as to project further than a rear end of the flat plate, and a cutout 36*a* is formed from a lateral center lying in the vicinity of a front end to a lateral center lying in the vicinity of the rear end of the flat plate. A sliding support piece 41*a* of the staple pushing member 41, which will be described later, is made to slide along the cutout 36*a*. In addition, the stoppers 36*d* are formed on the side walls of the magazine lid 36 in positions near the longitudinal centers thereof, and the stoppers 36*d* are brought into locking engagement with the openings formed in the side walls of the magazine main body 31, respectively, so as to prevent the magazine main body 31 from being caused to jump out to the front with force.

In addition, the magazine lid 36 has a driving blade locking projection 36*c* which is formed at the front end of the flat plate in such a manner that a surface of the magazine lid 36 continues to extend from the front end thereof. A sprig support member 44, which will be described later, is fixed to the vicinity of the front end of the magazine lid 36 as is shown in FIG. 10, and a spring attaching portion 36*b* is provided in the vicinity of the rear end thereof. In addition, shaft holes are formed in the side walls of the magazine lid 36 in positions near to the rear ends thereof so that the spindle 25 is inserted and passed therethrough. Furthermore, the driving blade locking projection 36*c* is brought into locking engagement with the driving blade 46 attached to a first push-down member 51, and one end of a coil spring 43 is attached to the spring attaching portion 36*b*.

The staple pushing mechanism includes the staple pushing member 41 for pushing a staple accommodated in the magazine main body 31 against the front end thereof and the coil spring 43 for biasing the staple pushing member 41. In addition, the staple pushing member 41 is made up of a rectangular flat plate, side walls which extend downwards vertically from ridge portions of the flat plate, bent back portions which are bent laterally inwards at right angles from lower ends of the side walls and a sliding support piece 41*a* which is formed in the vicinity of a rear end of the flat plate and is attached slidably to the magazine main body 31 in such a manner as to straddle the sliding assist member 33.

The coil spring 43 is a tension spring and is attached to the spring attaching portion 36*b* which is formed in the vicinity of the rear end of the magazine lid 36 at one end thereof. The coil spring 43 is bent or turned back at the spring support member 44 provided in the vicinity of the distal end of the magazine lid 36 so as to be attached to the staple pushing member 41 at the other end thereof.

In addition, the staple pushing mechanism biases the staple pushing member 41 forwards by virtue of the elastic force of the coil spring 43, and when staples are loaded in the magazine main body 31, the staple pushing member 41 pushes a staple against the front end of the magazine main body 31, whereby there is always a staple which is positioned at the front end of the magazine main body 31.

As is shown in FIG. 11, the magazine main body locking mechanism is made up of the rear end locking member 55 for locking the rear end locking projection 31*b* of the magazine main body 31 and a rotating arm 56 for rotating the rear end locking member 55. The rear end locking member 55 is disposed in the vicinity of the rear end of the magazine main body 31 and includes, as is shown in FIG. 10, two L-shaped plates 55*a* which have shaft holes in the vicinity of distal end portions of both the plates and which are disposed in such a manner as to oppositely face each other, a connecting portion 55*b* which connects together the L-shaped plate 55*a* near corner portions and a rotation control portion 55*c* which is connected with the connecting portion 55*b* and which controls the rotation of the rear end locking member 55 as is shown in FIG. 11.

In addition, in the rear end locking member 55, as is shown in FIG. 10, a spring locking shaft 55*d* is inserted and passed through the shaft hole formed in the distal end portions of the L-shaped plates 55*a*, and the rear end locking member 55 is pivotally attached to the spindle 25 which is inserted and passed through shaft holes formed in the other ends of the L-shaped plates 55*a* . In addition, a torsion spring 57 is installed on a circumferential edge of the spindle 25 which is positioned between the two L-shaped plates 55*a*, and one end of the torsion spring 57 is locked on the spring locking shaft 55*d* and the other end thereof is locked on the rear end locking projection 31*b* of the magazine main body 31.

In addition, the rotation control portion 55*c* of the rear end locking member 55 is, as is shown in FIG. 1, positioned outside the base portion 2 and locks on the rotating arm 56.

As is shown in FIG. 11, the rotating arm 56 includes a shaft hole 56*b* via which the rotating arm 56 is pivotally attached to a cover member, not shown, in substantially a longitudinal center thereof, as well as a grip portion 56*c* which is provided at a front end thereof. Thus, the rotating arm 56 is pivotally attached to rotate to the cover member via the shaft hole 56*b*, and when the grip portion 56*c* is pushed down, a rear end of the rotating arm 56 is moved upwards so as to be brought into locking engagement with the rotation control portion 55*c* of the rear end locking member 55, whereas when the grip portion 55*c* is pushed up, the rear end is moved downwards, and the locking engagement with the rotation control portion 55*c* is released.

Thus, in the magazine main body locking mechanism, by the grip portion 56*c* of the rotating arm 56 being pushed downwards, the rear end locking member 55 is rotated upwards on the spindle 25, so as to release the locked state between the torsion spring 57 and the rear end locking projection 31*b*, whereby the magazine main body 31 is allowed to slide. In addition, when the locked state at the rear is released, the magazine main body 31 projects forwards as a result of being biased forwards by the staple pushing mechanism and is stopped in a predetermined position by the stoppers 36*d* on the magazine lid 36. Because of this, there is caused no situation in which the magazine main body 31 jumps out forwards with force, and by the magazine main body 31 being pulled out by gripping the grip member 38 after it has been stopped by the stoppers 36*d*, stapled can be made to be accommodated in the magazine main body 31.

In addition, when the grip portion 56*c* of the rotating arm 56 is moved upwards, the locking engagement between the rear end of the rotating arm 56 and the rear end locking member 55 is released, the rear end locking member 55 is allowed to restore its original position by virtue of the elastic force of the torsion spring 57.

As is shown in FIG. 4, the push-down member 5 includes the first push-down member 51 which is pivotally attached to rotate to the pedestal member 11 in the vicinity of a rear end thereof by the spindle 25, the second-push down member 52 which is pivotally attached to rotate in the attaching portions 11*c* of the pedestal member 11 above the first push-down member 51, and a crank member 53 which connects together the first push-down member 51 and the second push-down member 52.

As is shown in FIG. 12, the first push-down member 51 is made up of two side walls which oppositely face each other and a connecting plate which connects together the two side walls in the vicinity of front ends thereof and has shaft holes 51*a*, 51*b* at rear ends and upper ends in the vicinity of a longitudinal center of the side walls. The spindle 25 is inserted and passed through the shaft holes 51*a* at the rear ends of the side walls, and the first push-down member 51 is pivotally attached to the crank member 53 via the shaft holes 51*b* provided in the vicinity of the longitudinal centers of the side walls. In addition, the leaf spring 45 including the driving blade 46 is attached to a bottom surface of the connecting plate of the first push-down member 51, and furthermore, a third biasing spring 49 made up of a pusher spring is attached to a position on the leaf spring 45 which lies in the vicinity of the front end of the leaf spring 45. Then, the leaf spring 45 and the third biasing spring 49 function to bias the first push-down member 51 upwards between the magazine lid 36 and itself.

The leaf spring 45 is such that the driving blade 46 at the front end and the slider pushing members 47 in the vicinity of the rear end are integrally formed, and the driving blade 46 includes an opening which locks on the driving blade locking projection 36*c* on the magazine lid 36, whereby when the stapler 1 is used, a staple situated at the distal end portion of the magazine main body 31 is driven out from the driving port 31*a* towards the movable clincher 15 lying therebelow.

In addition, the slider pushing portions 47 are formed in such a manner as to project obliquely rearwards from the side ridge portions of the leaf spring 45 and have outwardly bent thick portions 47*a* formed at rear ends thereof which are brought into locking engagement with the slider 13. The slider pushing portions 47 are situated, respectively, laterally outside of the side walls of the slider 13. Then, as is shown in FIG. 4, the thick portions 47*a* of the slider pushing portions 47 are in contact with the sliding support portions 13*a* of the slider 13, and when the leaf spring 45 is pressurized to be deflected between the magazine lid 36 and the first push-down member 51, distal end portions of the slider pushing members 47 are moved rearwards by the deflection so as to be brought into locking engagement with the sliding support portions 13*a* of the slider 13 so as to move the slider 13 to the rear.

Then, since a vertical position where the leaf spring 45 starts to be deflected changes depending upon the thickness of a batch of papers placed on the table 14, the position where the rear ends of the slider pushing portions 47 move to the rear differ depending upon the thickness of a batch of papers placed on the table 14. However, as has been described above, the front end surfaces of the sliding support portions 13*a* of the slider 13 are formed into the curved surfaces, the timing at which the slider pushing portions 47 start to pushing the slider 13 remains the same, and hence, there is caused no situation in which the clinching timing goes wrong.

As is shown in FIGS. 1 and 2, the second push-down member 52 includes two side walls which oppositely face each other and a connecting plate 52*a* which connects together the two side walls in the vicinity of front ends thereof. In addition, the side walls include collar portions 52*b* which lie in the vicinity of a rear end of the connecting plate 52*a*, and the collar portions 52*b* are each bent transversely inwards and constitute a plane which extends downwards to the rear from the rear end of the connecting plate 52*a*.

In addition, the second push-down member 52 has attaching holes in the vicinity of rear ends of the side walls and shaft holes in the vicinity of the rear end of the connecting plate 52*a* . These attaching holes are rotatably attached to the shaft holes 11*c* of the pedestal member 11, and the crank member 53 is pivotally attached in the shaft holes provided in the vicinity of the rear ends of the side walls. Then, the second push-down member 52 is rotatably attached to the pedestal member 11 and is connected with the first push-down member 51 by the crank member 53.

As is shown in FIG. 4, the crank member 53 is made up of a flat plate and side walls which extend downwards vertically from side ridge portions of the flat plate and have shaft holes in the vicinity of front ends and rear ends of the side walls. In addition, the crank member 53 is pivotally attached to the first push-down member 51 via the front shaft holes and is pivotally attached to the second push-down member 52 via the rear shaft holes, so as to link actions of both the members with each other.

Then, in the push-down member 5, when a force is applied to the second push-down member 52 from thereabove, the second push-down member 52 is lowered, and the first push-down member 51, which is connected to the second push-down member 52 via the crank member 53, is also lowered in a linked fashion with the lowering of the second push-down member 52, whereby the magazine portion 3 which is disposed below the first push-down member 51 is lowered. In addition, when the first push-down member 51 rotates upwards, the second push-down member 52, which is connected to the first push-down member 51 via the crank member 53, also rotates upwards.

As is shown in FIG. 13, the handle support member 7 includes two side plates 7*a* which are disposed in such a manner as to oppositely face each other and a front wall 7*b* which connects together the two side plates 7*a*, and is fixed to the pedestal member 11 in such a manner that portions of the two side plates 7*a* which lie in the vicinity of lower ends thereof are positioned slightly further forwards than the centers of the side walls of the pedestal member 11. In addition, the side plates 7*a* are each made up of a base which is substantially rectangular and is fixed to the pedestal member 11 and a handle member fixing portion which is formed in such a manner as to project forwards and upwards from a position lying above a front end of the base.

In addition, a shaft hole is provided in the handle member fixing portion in a position lying above a front upper end thereof, and the handle member 6 is fixed to the shaft holes formed in the handle member fixing portions via a handle shaft 62. Furthermore, the front wall 7*b* is formed in such a manner as to extend obliquely from a front upper to a rear lower position, and a sliding hole 7*c* is provided in a center of the front wall 7*b* in such a manner that a control member 82 of a paper holding mechanism 8, which will be described later, slides therealong.

Additionally, the handle support member 7 includes the paper holding mechanism 8 which is used to make a paper fastening position constant when fastening together sheets of paper, and this paper holding mechanism 8 is made up of a paper stopper member 81 with which sheets of paper placed on the table 14 for fastening are brought into abutment and the control member 82 for controlling the operation of the paper stopper member 81. In addition, the paper stopper portion 81 is made up of two side plates which are disposed in such a manner as to oppositely face each other and a connecting plate which connects together the two side plates in the vicinity of upper ends of the side plates. The control member 82 is made into a screw which includes a grip portion at a screw head.

In addition, the side plate of the paper stopper member 81 has an inclined portion which is formed to have the same inclination as that of the front wall 7*b* of the handle support member 7 which is positioned thereabove and a vertically suspended portion which is normal to a resting plane situated therebelow on which the stapler 1 rests when it is placed thereon, and the inclined portions of the side plates are connected together by a connecting plate. In addition, the paper stopper member 81 is disposed inside the handle support member 7 in such a manner that the front wall 7*b* of the handle support member 7 oppositely faces the connecting plate of the paper stopper member 81, and the control member 82 penetrates the sliding hole 7*c* formed in the front wall 7*b* of the handle support member 7 from the outside so as to be screwed to the connecting plate of the paper stopper member 81. Furthermore, a tension spring is attached to the vicinity of an upper end of the paper stopper member 81 and the handle member 6, so as to bias the paper stopper member 81 upwards.

In this paper holding mechanism 8, when the control member 82 is screwed loosely, the control member 82 is caused to slide to an upper end of the sliding hole 7*c* by virtue of the elastic force of the tension spring attached to the paper stopper member 81, and similarly, the paper stopper member 81 is also caused to move upwards. Therefore, a lower end of the vertically suspended portion which is a lower end of the paper stopper member 81 moves upwards to a position where it lies sideways of the magazine portion 3 from a position shown in FIG. 1 where it lies between the table 14 and the magazine portion 3. By this action, since nothing locking on sheets of paper to be fastened exists between the table 14 and the magazine portion 3, when sheets of paper to be fastened together are placed on the table 14 and are then pushed rearwards, the papers are brought into locking engagement with the front ends of the side plates 7*a* of the handle support member 7 to be stopped, whereby clinching can be implemented in a constant position at all times by clinching being carried out in the state described above. Note that a distance between the movable clincher 15 and the front end of the handle support member 7 is made to be 20 mm, and this allows the implementation of clinching in a position spaced apart 20 mm from the end of the papers.

In addition, when the control member 82 is caused to slide along the sliding hole 7*c* to a lower end of the same hole, the paper stopper member 81 is also caused to move to the lower end while being supported by the control member 82, the lower ends of the side plates of the paper stopper member 81 move to the vicinity of the upper ends of the side walls of the pedestal member 11. Then, by screwing the control member 82 to the paper stopper member 81 strongly so that the handle support member 7 is held between the control member 82 and the paper stopper member 81, the control member 82 is made stationary, and when sheets of paper to be fastened are placed on the table 14 and are then pushed rearwards, the sheets of paper are brought into locking engagement with the front ends of the vertically suspended portions of the paper stopper member 81 to be stopped thereat. By implementing clinching in this state, papers can be clinched in the constant position at all times. Note that a distance between the movable clincher 15 and the vertically suspended portions of the paper stopper member 81 is made to be 10 mm, and therefore, clinching can be carried out in a position situated 10 mm apart from the end of the papers.

In this way, with the paper holding mechanism 8, by sliding the control member 82 along the sliding hole 7*c*, clinching can be implemented in the constant position which is 10 mm or 20 mm apart from the end of papers to be fastened together.

In addition, in this embodiment, while the control member 82 takes the form of the screw, the invention is not limited thereto, and hence, members of other forms or other constructions can be adopted, provided that the paper stopper member 81 can be stopped thereby. For example, a construction can be adopted in which a control member 82 is made up of a pin which has a head at one end and a locking portion at the other end and a spring wound round a circumference of the pin, the pin is inserted and passed through the sliding hole 7*c* from the outside and is further inserted and passed through the connecting plate of the paper stopper member 81, and the locking portion is made to be locked on a rear surface of the connecting plate, a pusher spring being positioned between the head of the pin and the handle support member 7. By adopting the construction described above, although at normal times, the locking portion of the pin and the paper stopper member 81 are strongly locked on each other by virtue of the elastic force of the pusher spring so as to make the paper stopper member 81 stationary, when the head of the pin is pushed in, the locking engagement between the locking portion of the pin and the paper stopper member 81 is weakened, whereby the pin is allowed to slide along the sliding hole 7*c*.

The handle member 6 is made up of a rectangular flat plate and side walls which extend downwards vertically from the flat plate, and as is shown in FIG. 4, a roller 61 is fixed in place between the side walls in a position lying in the vicinity of a center between the side walls. In addition, the handle member 6 has shaft holes in the vicinity of front ends of the side walls and is pivotally attached to the handle support member 7 by the handle shaft 62 in a position which lies in the vicinity of the front end of the stapler 1, and the roller 61 is now in contact with the connecting plate of the second push-down member 52. Furthermore, a torsion spring 63 is attached to the handle shaft 62, whereby the handle member 6 is biased in an opening direction.

Then, the handle member 6 pushes down the portion of the second push-down member 52 which lies in the vicinity of the front end thereof so as to lower the same by making use of the principle of leverage in which the handle shaft 62, which is the shaft positioned in the vicinity of the front end of the stapler 1, acts as a fulcrum, the rear end of the handle member 6 acts as a point of effort and a point where the roller 61 is in contact with the upper surface of the second push-down member 52 acts as a point of application.

Since the stapler 1 of the embodiment makes use of the principle of leverage in the way described above, the handle member 6 can be made to rotate downwards with a weak force, and since the roller 61 is used at the point of application, friction produced with the second push-down member 52 can also be reduced. In addition, since the construction is adopted in which the portion of the second push-down member 52 is pushed down which lies in the vicinity of the front end thereof, load to be exerted on to the second push-down member 52 may only have to be small, whereby sheets of paper can be fastened together with weaker force.

In addition, although not shown, in the staple 1 of the embodiment, covers are attached, respectively, to the base portion 2, the magazine portion 3, the push-down portion 5, the handle member 6, and the handle support member 7 so as to cover them individually.

Next, the operation of the stapler 1 of the embodiment will be described. With sheets of paper to be fastened together being placed on the table 14 in such a state that the handle member 6 is opened or released as is shown in FIG. 14, when a force is exerted on to the handle member 6 from thereabove so as to cause the handle member 6 to rotate downwards as is shown in FIG. 15, the second push-down member 52 is pushed down by the roller 61 of the handle member 6 to lower, and the first push-down member 51 also lowers which connects together the second push-down member 52 and the crank member 53. Then, the magazine portion 3 also lowers as a result of being pushed down by the first push-down member 51, whereby a lower part of the front end of the magazine main body 31 is brought into contact with the movable clincher 15. When this state is resulting, the leaf spring 45 and the third biasing spring 49 which are disposed between the magazine portion 3 and the first push-down member 51 are not contracted.

When the force is applied further to the handle member 6 from thereabove, as is shown in FIG. 16, since the clinching portion 10 does not lower due to being in locking engagement with the slider locking portions 23*b* of the licking member 23, the leaf spring 45 and the third biasing spring 49 are contracted by being held between the magazine lid 36 and the first push-down member 51, and the distal end portions of the slider pushing portions 47 which are formed integrally with the leaf spring 45 are actuated to move rearwards. Then, the slider 13 which is supported by the sliding support portions 13*a* of the slider 13 which are in locking engagement with the slider pushing portions 47 are caused to slide rearwards along the sliding support shafts 17.

Then, when the force is applied further to the handle member 6 from thereabove, as is shown in FIG. 17, the slider 13 is caused to slide rearwards further, and the locking engagement between the slider locking portions 23*b* of the locking member 23 and the slider 13 is released, whereby the holding of the clinching portion 10 is released to thereby allow the clinching portion 10 to rotate downwards at one time. This allows the clincher locking portions 23*a* of the locking member 23 to be brought into locking engagement with the lower part of the movable clincher 15 so as to cause the movable clincher 15 to rotate upwards, whereby a staple positioned at the lower end of the driving blade 46 is pushed against the movable clincher 15, and pointed ends of the staple are bent flat so as to fasten together the sheets of paper placed on the table 14.

Thereafter, when the handle member 6 is released, the clinching portion 10 is caused to rotate upwards by being biased by the first biasing spring 20, the magazine portion 3 is caused to rotate upwards by being biased by the second biasing spring 22, the push-down portion 5 is caused to rotate upwards by being biased by the leaf spring 45 and the third biasing spring 49, and the handle member 6 is also caused to rotate upwards by being biased by the torsion spring 63, whereby the handle member 6 is allowed to restore its original position shown in FIG. 14.

According to the stapler 1 of the embodiment, by the slider 13 being caused to slide along the sliding support shafts 17 by causing the sliding shafts 17 to be inserted and passed through the slider 13, even in the slider 13 is large in size, there is caused no such situation that the slider 13 is inclined during sliding. In addition, since the gap can be produced between the flat plate of the slider 13 and the table 14, the generation of friction between the flat plate of the slider 13 and the table 14 can be suppressed. Since this enables the smooth sliding of the slider 13, the clinching portion 10 is allowed to lower in a smooth fashion, whereby the force required for fastening together sheets of paper can be made small and fastening errors can be prevented.

In addition, by the handle member 6 adapted to make use of the principle of leverage being attached to the position above the second push-rod member 52, the force required for clinching is made small, and hence, a thick batch of papers can be fastened together with a small magnitude of force. Furthermore, by attaching the roller 61 to the position of the handle member 6 which acts as the point of application, the friction between the handle member 6 and the second push-rod member 52 is reduced, thereby making it possible to fasten together sheets of paper with a smaller magnitude of force.

Additionally, by the push-down portion 5 being attached rotatably to the vicinity of the rear end of the base portion 2 and the handle member 6 being attached rotatably to the vicinity of the front end of the handle support member 7, the center of gravity of the stapler 1 at the time of clinching moves to the vicinity of the center of the base portion 2, and hence, since the front of the base portion 2 does not have to be formed large, the stapler 1 can be provided which is small in size and which can fasten together a large number of sheets of paper.

In addition, by the magazine portion 3 being formed into the front loading type, staples can be loaded in the magazine main body 31 from the front without opening the push-down portion 5 and the handle member 6, whereby the design of the push-down portion 5 and the handle member 6 is facilitated.

Furthermore, by the paper holding mechanism being attached to the handle support member 7, the clinching position can be maintained constant, whereby the stapler 1 can be provided which can fasten together sheets of paper in a stable fashion.

In addition, by the front end face of the sliding support portions 13*a* of the slider 13 with which the slider pushing portions 47 are brought into locking engagement being formed into the curved surface which can match the thickness of a batch of papers to be fastened together, there is caused no such situation that clinching timing changes depending upon the thickness of sheets of paper to be fastened together, whereby the stapler 1 can be provided which can fasten together sheets of paper in a stable fashion.

Note that the invention is not limited to the embodiment that has been described heretofore and the techniques described in the embodiment can be applied to various products.

What is claimed is:

1. A stapler, comprising:

a base portion which comprises a rotatable clinching portion, a magazine portion which is pivotally attached to rotate to a position on the base portion by a spindle at a rear end thereof, a push-down portion which is pivotally attached at a rear end thereof to rotate to a position on the base portion disposed above the magazine portion and which has a driving blade at a front end thereof, and a handle member which is pivotally attached to rotate towards a handle support member which is fixed to an upper front end of the base portion and which is adapted to be brought into contact with a front end of an upper portion of the push-down member so as to lower the push-down member, wherein the clinching portion comprises a slider which permits a lowering operation of the clinching portion, wherein a plurality of sliding support shafts are penetrated through the slider, the slider sliding vertically relative to the sliding support shafts, and wherein the handle member comprises a roller in a position which is in contact with the push-down portion and lowers the push-down portion using leverage from a fulcrum formed by the handle member, and wherein a rear end portion acts as a point of effort and the contact point with the push-down member acts as a point of application.

2. The stapler according to claim 1, wherein:

the magazine portion is of a front-loading type which comprises a slidable magazine main body, a magazine accommodating portion for accommodating the magazine main body and a magazine main body locking mechanism; and the magazine main body locking mechanism has a rotatable rear end locking member for locking and releasing a rear end of the magazine main body and a rotation arm for controlling the rotation of the rear end locking member.

3. The stapler according to claim 2, further comprising a paper holding mechanism which comprises a paper stopper member and a control member, wherein:

the paper stopper member is made up of two side plates which are positioned to oppositely face each other and a connecting plate for connecting together the side plates at upper ends thereof and is positioned inside the handle support member such that a front wall of the handle support member and the connecting plate of the paper stopper member oppositely face each other; and the control member is connected with the connecting plate of the paper stopper member via a sliding hole formed in the front wall of the handle support member, and by causing the control member to slide along the sliding hole, the paper stopper member is caused to move vertically.

4. The stapler according to claim 3, wherein:

the driving blade is formed integrally with a leaf spring which comprises a slider pushing portion for locking the slider;

the slider comprises a sliding support portion which is locked by the slider pushing portion; and a front edge surface of the sliding support portion which is locked by the slider pushing portion is formed into a curved surface.

5. The stapler according to claim 2, wherein:

the driving blade is formed integrally with a leaf spring which comprises a slider pushing portion for locking the slider;

the slider comprises a sliding support portion which is locked by the slider pushing portion; and a front edge surface of the sliding support portion which is locked by the slider pushing portion is formed into a curved surface.

6. The stapler according to claim 1, further comprising a paper holding mechanism which comprises a paper stopper member and a control member, wherein:

the paper stopper member is made up of two side plates which are positioned to oppositely face each other and a connecting plate for connecting together the side plates at upper ends thereof and is positioned inside the handle support member such that a front wall of the handle support member and the connecting plate of the paper stopper member oppositely face each other; and the control member is connected with the connecting plate of the paper stopper member via a sliding hole formed in the front wall of the handle support member, and by causing the control member to slide along the sliding hole, the paper stopper member is caused to move vertically.

7. The stapler according to claim 6, wherein:

the driving blade is formed integrally with a leaf spring which comprises a slider pushing portion for locking the slider;

the slider comprises a sliding support portion which is locked by the slider pushing portion; and a front edge surface of the sliding support portion which is locked by the slider pushing portion is formed into a curved surface.

8. The stapler according to claim 1, wherein:

the driving blade is formed integrally with a leaf spring which comprises a slider pushing portion for locking the slider;

the slider comprises a sliding support portion which is locked by the slider pushing portion; and a front edge surface of the sliding support portion which is locked by the slider pushing portion is formed into a curved surface.

* * * * *